US006331684B1

(12) United States Patent
Abroy et al.

(10) Patent No.: US 6,331,684 B1
(45) Date of Patent: Dec. 18, 2001

(54) MODULAR SWITCH MECHANISM

(75) Inventors: Hamid S. Abroy; David E. Greer, both of Lexington; John K. Leppla, Georgetown, all of KY (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/474,966

(22) Filed: Dec. 30, 1999

(51) Int. Cl.[7] ..... H01H 3/00
(52) U.S. Cl. ..... 200/17 R; 200/329
(58) Field of Search ..... 200/17 R, 18, 200/50.21–50.36, 242, 254, 293, 295, 296, 299, 303, 307, 329, 330, 331, 337, 401, 554; 218/152, 153, 154

(56) References Cited

U.S. PATENT DOCUMENTS

| | | | |
|---|---|---|---|
| 3,684,849 | 8/1972 | Zubaty | 200/554 |
| 3,970,808 | 7/1976 | Gryctko et al. | 200/50.15 |
| 4,225,765 | 9/1980 | Johnston et al. | 200/307 |
| 4,302,643 | 11/1981 | Cox et al. | 218/152 |
| 4,395,606 | 7/1983 | Zaffrann et al. | 218/149 |
| 5,243,161 | 9/1993 | Cox et al. | 200/308 |
| 5,322,982 | 6/1994 | Leger et al. | 200/401 |
| 5,434,376 | 7/1995 | Hyatt et al. | 200/293 |
| 5,559,489 | 9/1996 | Weiden | 337/215 |
| 5,609,246 | 3/1997 | Cassity et al. | 200/283 |
| 5,633,619 | 5/1997 | Oetjen et al. | 337/143 |
| 5,737,195 | 4/1998 | Cassity et al. | 361/823 |
| 5,739,488 | 4/1998 | Cassity et al. | 200/17 R |
| 5,746,306 | 5/1998 | Cassity et al. | 200/283 |
| 5,777,283 * | 7/1988 | Greer | 200/18 |
| 5,977,492 | 11/1999 | Taylor et al. | 200/50.32 |
| 5,986,211 | 11/1999 | Greer et al. | 174/61 |

* cited by examiner

*Primary Examiner*—J. R. Scott
(74) *Attorney, Agent, or Firm*—David R. Stacey; Larry T. Shrout; Larry I. Golden

(57) ABSTRACT

A switch mechanism module for a switch including a first housing member, a second housing member, and an operating mechanism between the first and second housing members. The first housing member has first and second integral stops depending therefrom, and the second housing member has first and second integral legs depending therefrom. The operating mechanism rotates upon rotation of the handle of the switch causing rotation of the rotor of the switch. Movement of the operating mechanism ceases upon engagement of the operator cam with the stop of the first housing member. The integral legs of the second housing member provide reinforcement for the stops to prevent movement of the stops in the direction of the rotating cam.

19 Claims, 33 Drawing Sheets

MODULAR SWITCH MECHANISM

DESCRIPTION

Technical Field

The present invention relates generally to switches and, more particularly, to switching mechanisms for fusible and non-fusible switch assemblies.

BACKGROUND OF THE INVENTION

Switches are usually mounted in an enclosure and incorporate an insulating base to carry an incoming line base for each phase. The circuit for each phase is completed through a pivotal knife blade which engages a corresponding contact to electrically connect the line current to the load. Switches can be fusible or non-fusible. In fusible switches the blade engages a contact which is electrically connected to a fuse clip having a fuse seated thereon. The fuse is then electrically connected to the load. U.S. Pat. Nos. 4,302,643, and 5,777,283, commonly assigned to the Square D Company, disclose a fusible switch utilizing the abovementioned construction. The disclosures of such patents are hereby incorporated herein by reference. In non-fusible switches the blade engages a contact which is directly electrically connected to the load.

Switches, and particularly fusible switches, are used in switchboards to disconnect and distribute power for commercial and industrial applications. The need arises to distribute more power through enclosures which are the same size or smaller. This requires increasing the electrical rating of the switch to carry a higher voltage and current density while decreasing the size of the enclosure housing and mounting mechanism housing the electrical parts.

Among the problems caused by decreasing the space requirements of a switch is the additional components within the switch, including the components necessary for: mounting different types of fuses; hinging the blade; engaging the end of the blade; providing springing capability to the blade hinge, blade jaw, and fuse clip; mounting the line lug and load lug; connecting the fuse clips and blade jaws with the line lug and load lugs; connecting the line bases; mounting the rotor mechanism; providing a rotor cam stop; providing a switching mechanism housing; and, connecting the switching mechanism to the switch. Multiple parts and multiple connecting hardware has resulted in increased cost, increased inventory, increased assembly time and complexity of assembly, and has reduced the flexibility for field replacement of interior components and conversion from a fusible to non-fusible switch and vice-versa. Further, decreasing the space requirements of a switch has decreased the efficiency of the switching mechanism.

Accordingly, there is a need for an effective and efficient means for providing a switch assembly and switching mechanism. One of the requirements for such a switch and switch assembly includes that the part count must be reduced and made such that parts that were once unique to a single element, are now compatible with multiple elements and uses. This will reduce inventory, supply and assembly problems. Further, the switch assembly must be economical to manufacture, the switch must be capable of being assembled easier and faster to reduce cost, field assembly and retrofit must be simplified, and the switch must have more widespread application.

SUMMARY OF THE INVENTION

The switch mechanism of the present invention provides a limited number of components for use with both a fusible and a non-fusible switching assembly. These components are easier to manufacture and assemble, and require less mounting hardware than prior switching mechanisms. As such, the present invention provides a switch mechanism that is less expensive, more efficient, and requires less inventory than prior switch mechanisms.

According to one aspect of the present invention, the switch mechanism module comprises a first housing member, a second housing member, and an operating mechanism. The first housing member has a substantially planar wall and an integral stop depending therefrom. The second housing member mates with the first housing member around the operating mechanism, and has a substantially planar wall and an integral leg depending therefrom. The operating mechanism has a cam adapted to rotate upon movement of a handle. The integral stop of the first housing member, however, stops movement of the cam in one direction, and the integral leg of the second housing member provides reinforcement for the stop.

According to another aspect of the present invention, the operating mechanism comprises a handle cam, an operator cam, a rotor cam, a bias spring, a mechanism shaft extending through an aperture in the handle cam and operator cam, and connecting to the rotor cam, a push rod pivot connected to the first housing member, the push rod pivot engaging a push rod, and an operator spring around the push rod. The handle cam and the operator cam are adapted to rotate about the shaft upon rotation of the handle. Rotation of the operator cam energizes the push rod causing an energized push rod to quickly accelerate the operator cam causing rotation of a rotor cam. The rotor cam is connected to the rotor of the switching assembly, causing movement of the blade thereof.

According to another aspect of the present invention, the handle cam and operator cam has an arcuate slot with opposing fingers at ends of the slot. One end of the bias spring engages the fingers at one end of the slot of the handle cam and operator cam, and the other end of the bias spring engages the fingers at the other end of the slot of the handle cam and operator cam to connect the two cams.

According to another aspect of the present invention, the rotor cam is adjacent the operator cam. The rotor cam has a first side and a second side. A hub extends from the second side of the rotor cam. The hub has a geometrically shaped indentation adapted to mate with a protrusion of a rotor of the switch.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
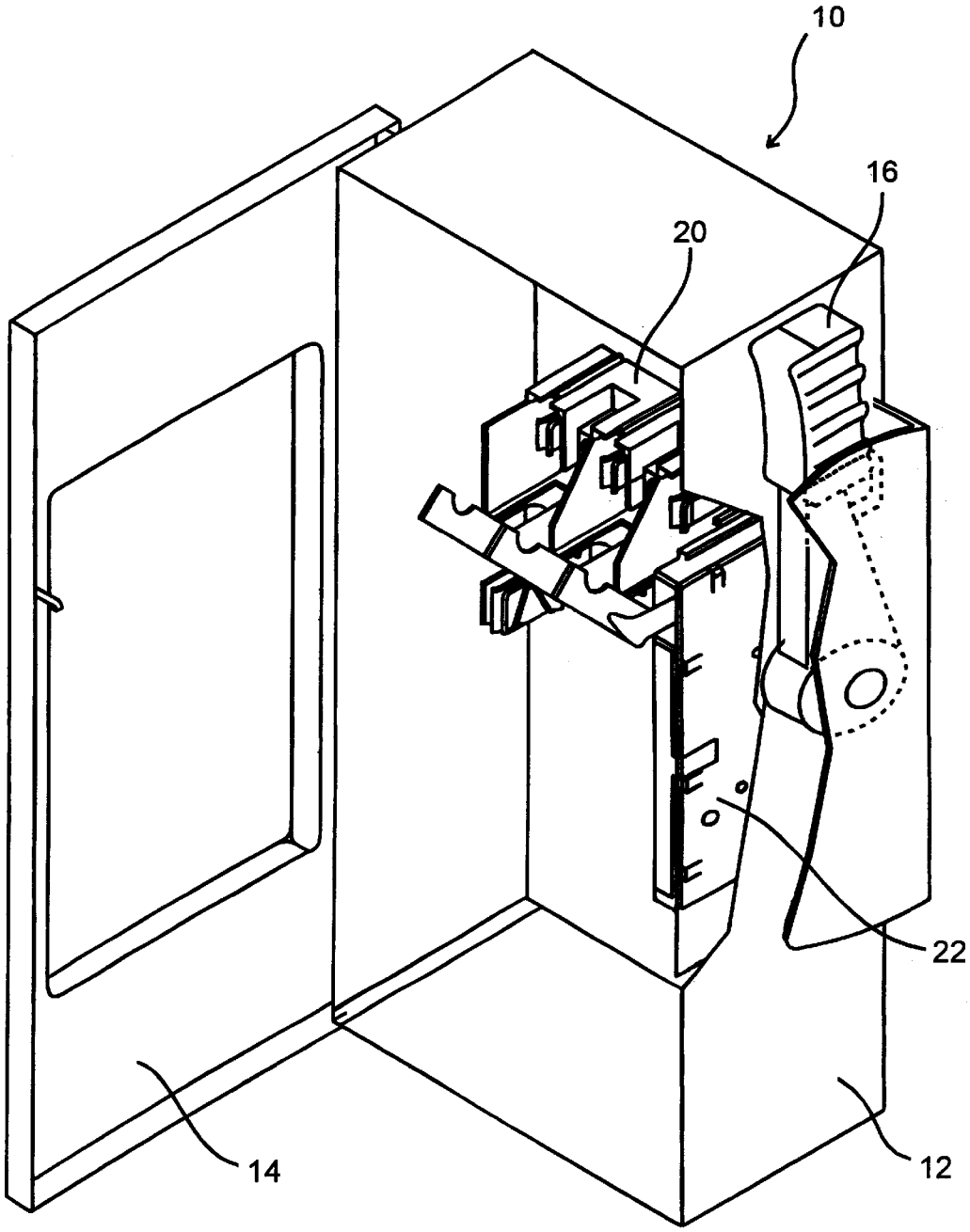
FIG. 1 is a perspective view of an enclosure containing a switch assembly according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now in detail to the Figures, and initially to FIG. 1, there is shown a switch 10 for a multi-phase circuit. The switch 10 includes an enclosure 12 having a swinging cover 14, and a handle 16. The interior of the switch 10 houses a switching assembly 20 and a switching mechanism 22. In a multi-phase circuit, there is an electrical power line to service each respective phase entering the enclosure 12. The switch described herein is capable of being utilized at least for a two-, three-, four- or six-phase circuit. In accordance with the teachings herein, one with the knowledge of one of ordinary skill in the art would be able to change the number of phases and modify the invention accordingly.

Figure 2:
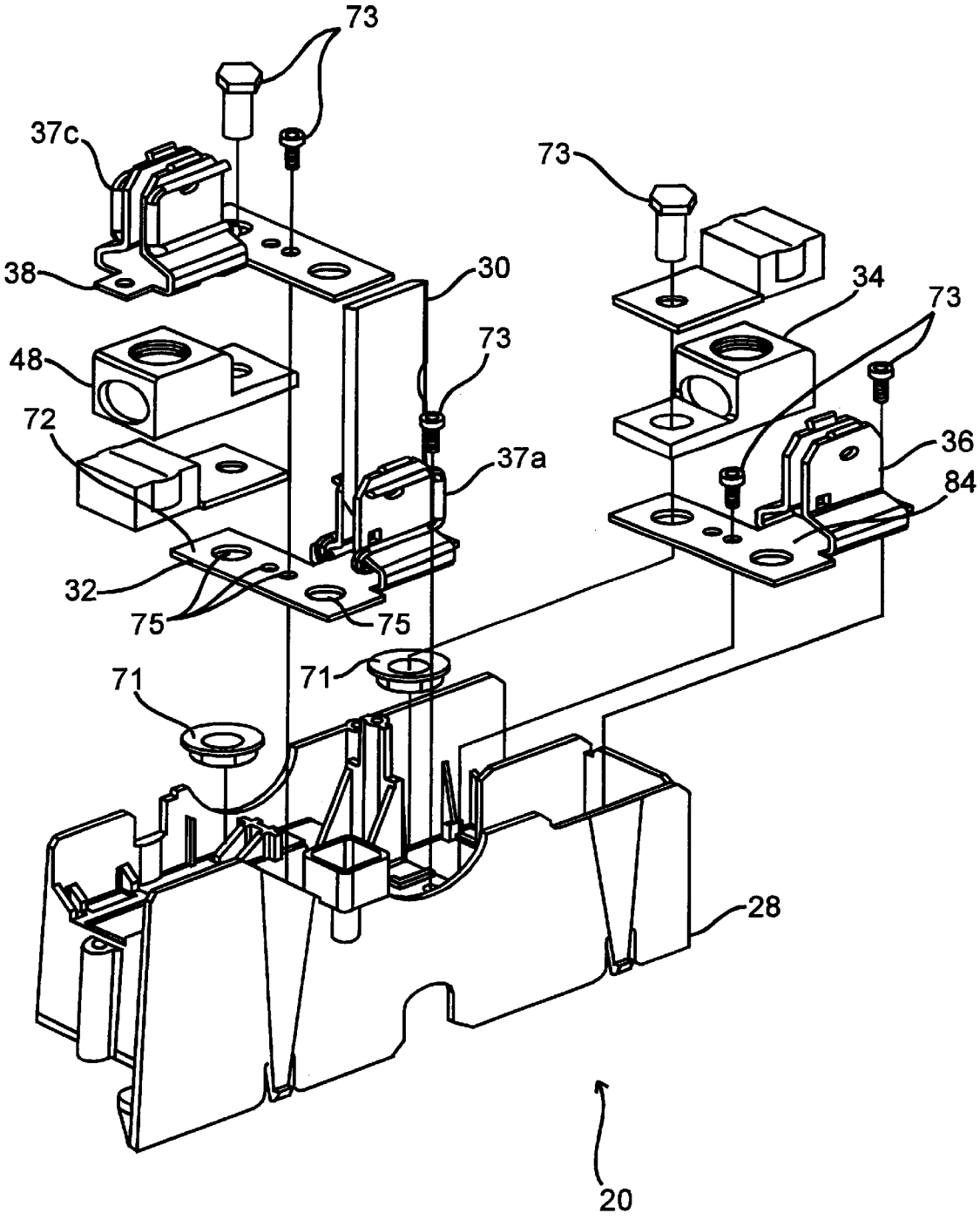
FIG. 2 is an exploded view of various embodiments of a single pole of a switch assembly of the present invention.
Figure 6A:
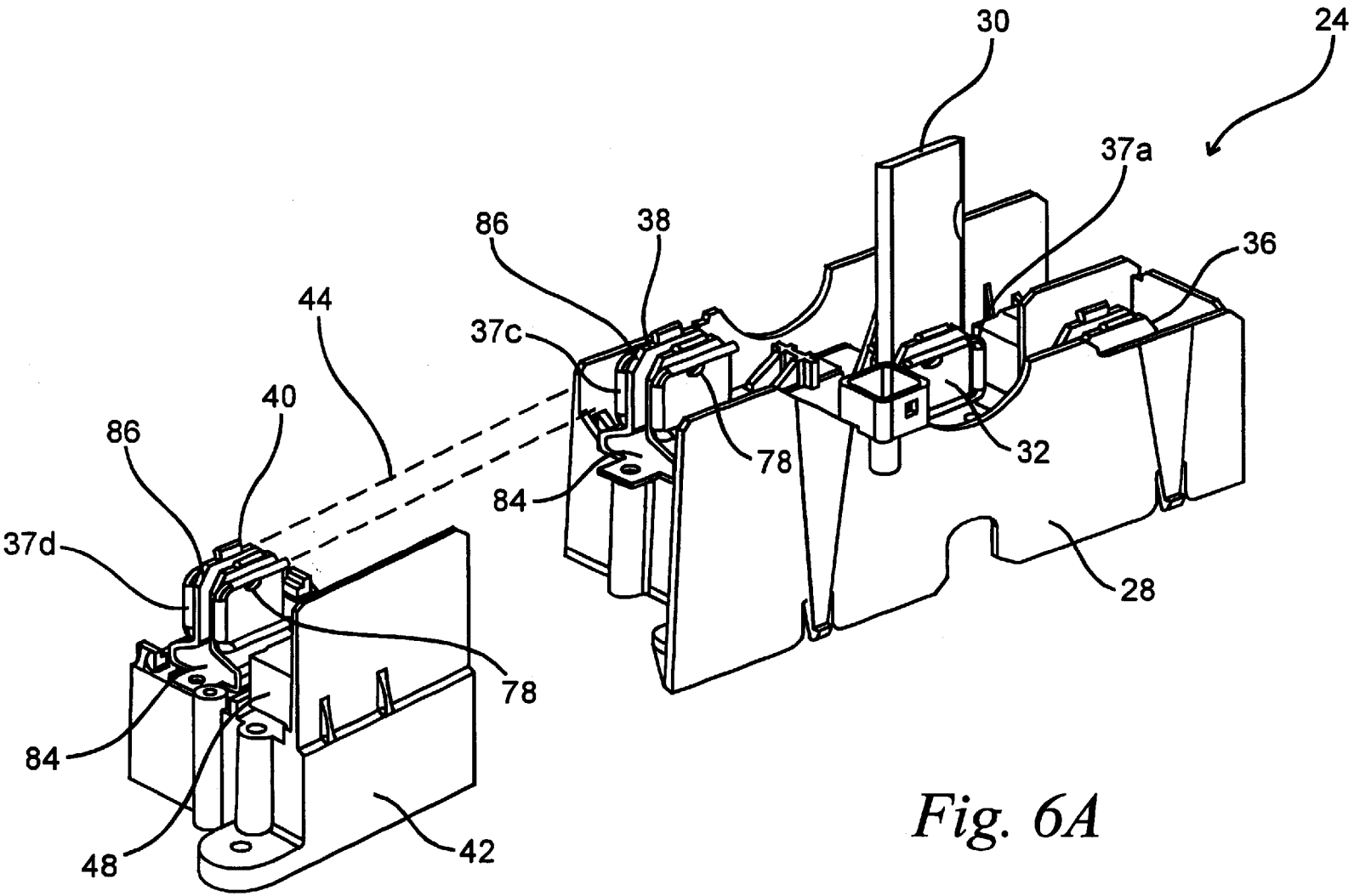
FIG. 6A is a perspective view of a fusible switch assembly of the present invention.
Figure 6B:
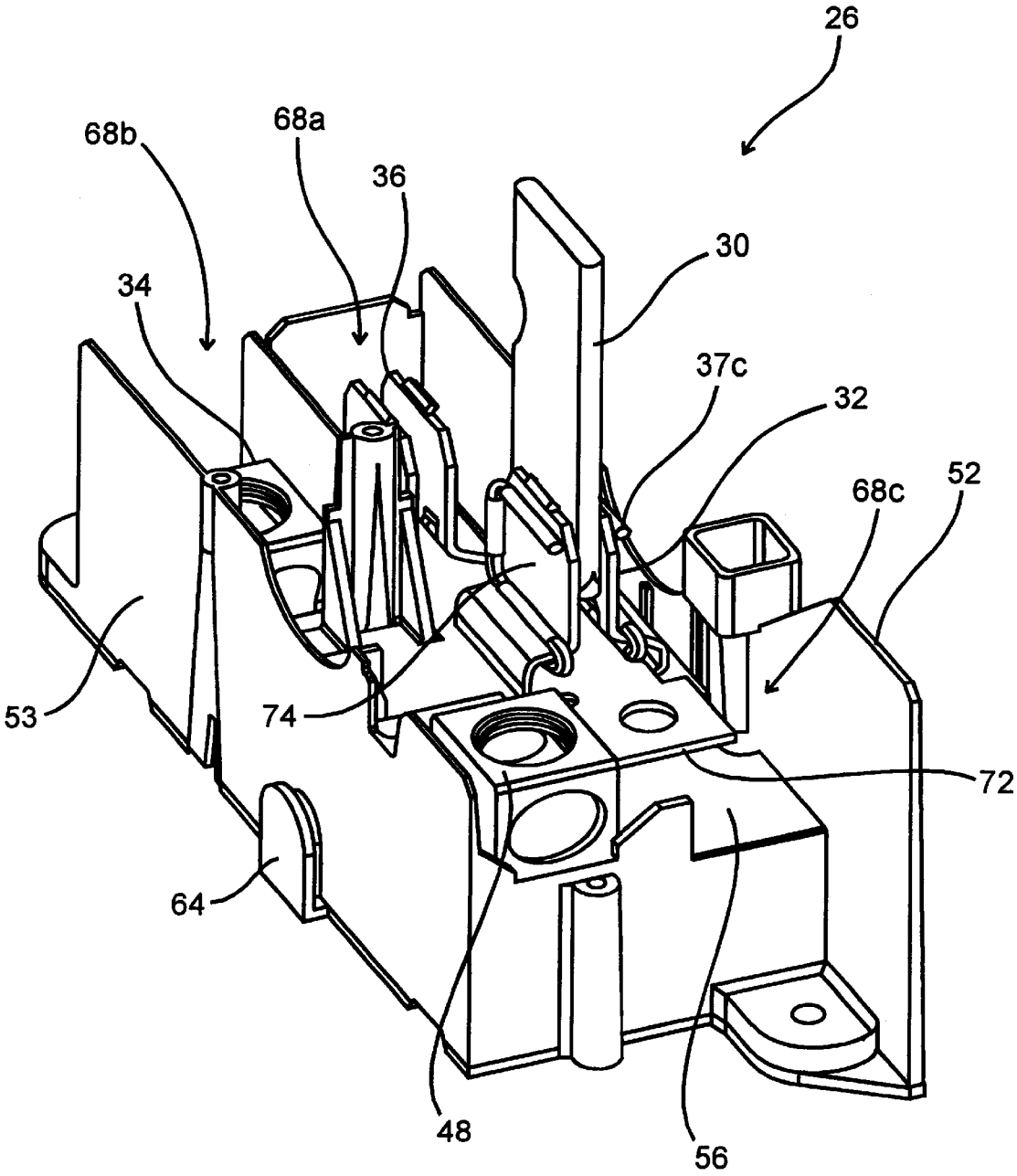
FIG. 6B is a perspective view of a non-fusible switch assembly of the present invention.

As illustrated in FIG. 2, the switching assembly 20 is modular and is adapted to be modified into a fusible switch 24 (see FIG. 6A) and a non-fusible switch 26 (see FIG. 6B). In either configuration, the switching assembly 20 generally includes an insulating base 28, a blade 30, a blade hinge member 32, a rotor element 33, a line terminal 34, and a first contact member 36. To modify the base switching assembly to form a fusible switch 24, the following components are also included: a second contact member 38, a third contact member 40, a second insulating base 42, a fusible member 44, and a load terminal 48. To modify the base switching assembly to form a non-fusible switch 26, a load terminal 48 is added to the insulating base 28.

Figure 7A:
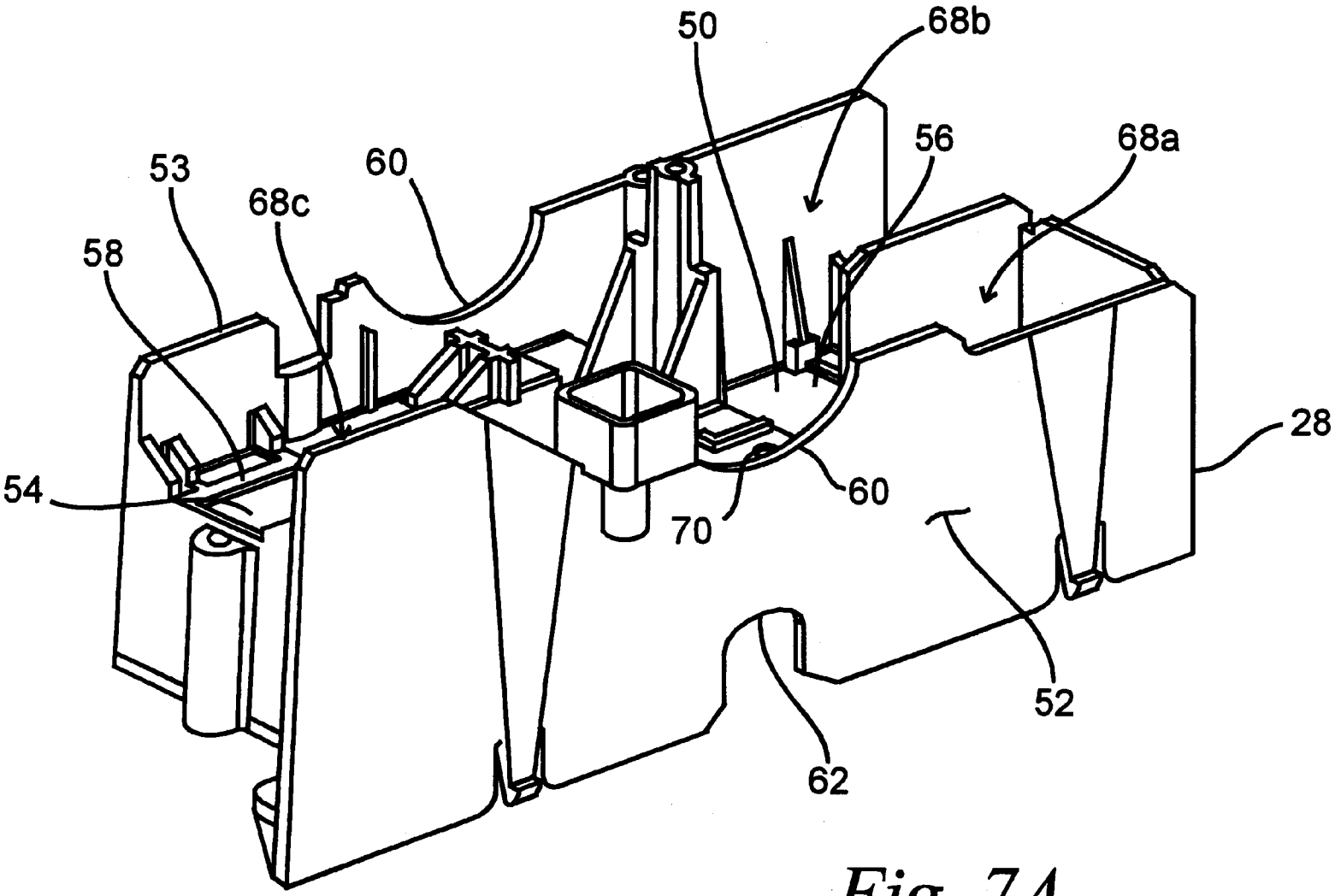
FIG. 7A is a front perspective view of the insulated base of the present invention.
Figure 7B:
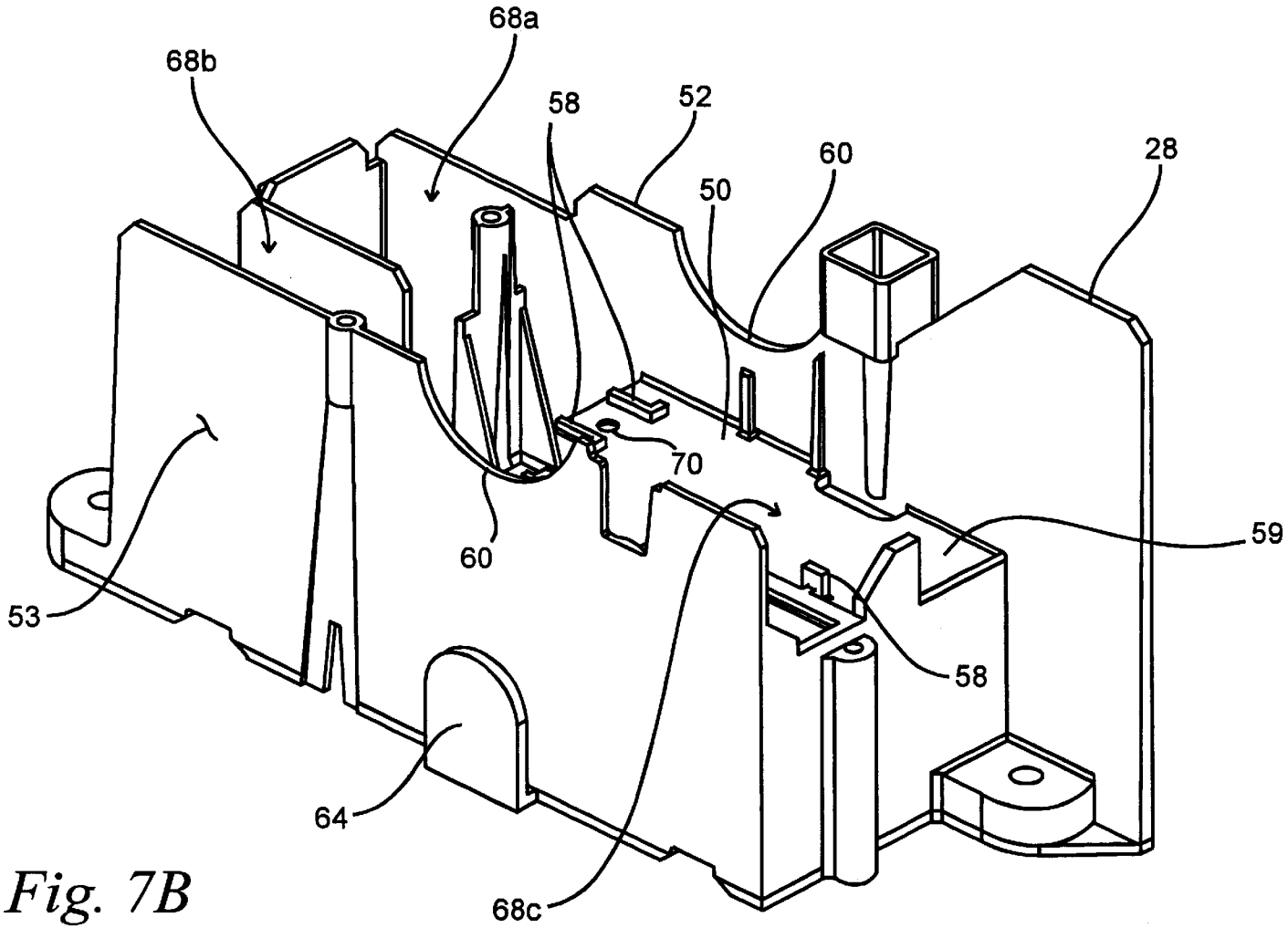
FIG. 7B is a rear perspective view of the insulated base of FIG. 7A.

As illustrated in FIGS. 7A–7B, the first insulating base 28 of the switching assembly, commonly referred to as a line base, operates to provide a module for a single phase of a multi-phase circuit. The insulating base 28 is integrally formed of an electrically insulating material, such as a thermoplastic sold by the General Electric Company under the name tradename Valox. A plurality of interlocking first insulating bases 28 are mounted adjacent each other and connected to respective line service for each phase. The insulating base 28 generally has a bottom surface 50 integral with (i.e., manufactured as one element) opposing sidewalls 52,53. The bottom surface 50 of the insulating base comprises a plurality of offset and substantially parallel plane surfaces 54,56. Additionally, while still part of the bottom surface 50, a plurality of integral protrusions 58 extend therefrom. Many of the protrusions 58 are utilized as positioning members for positioning additional components therein.

Figure 8A:
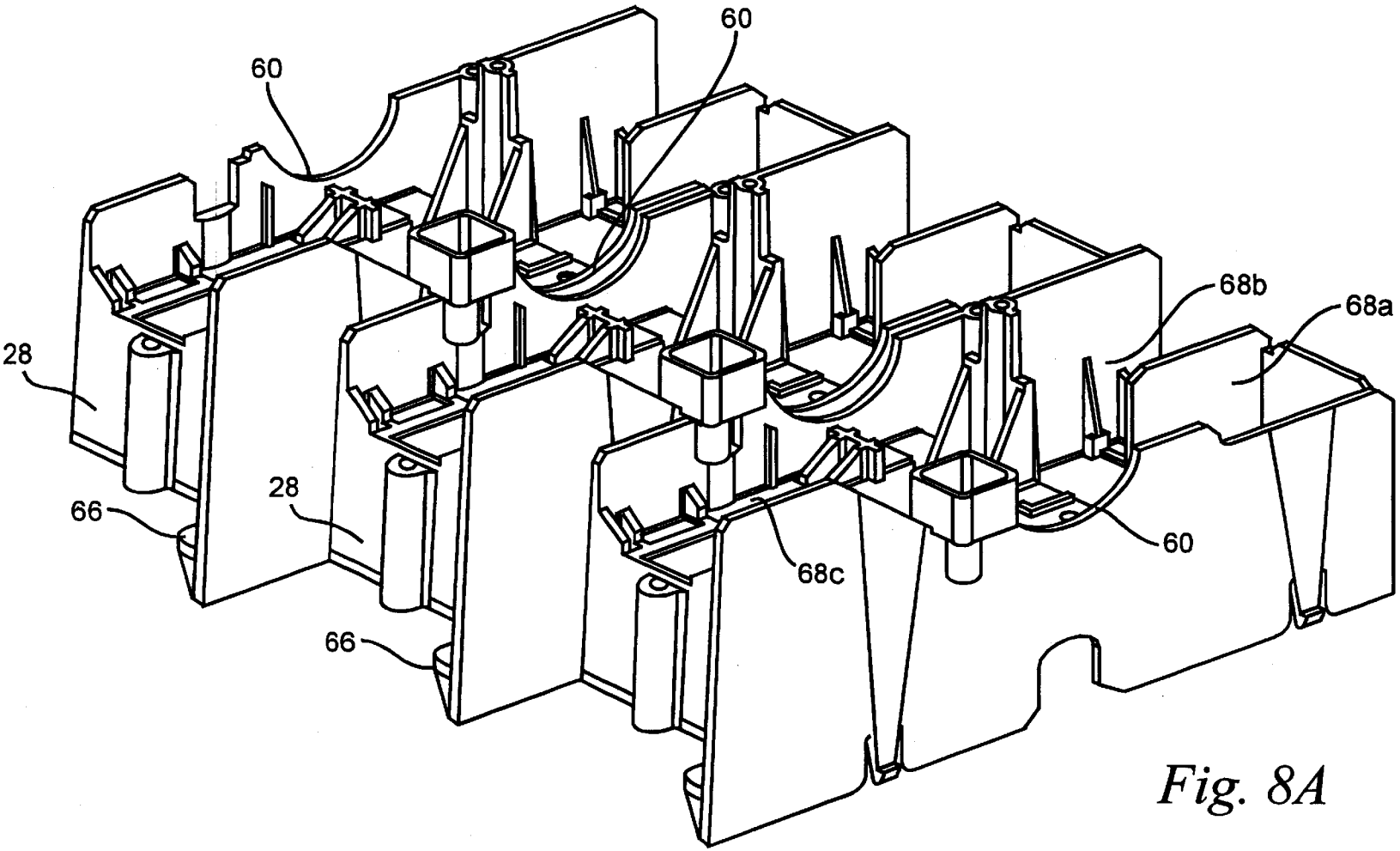
FIG. 8A is a top perspective view of connected base assemblies of the present invention.
Figure 8B:
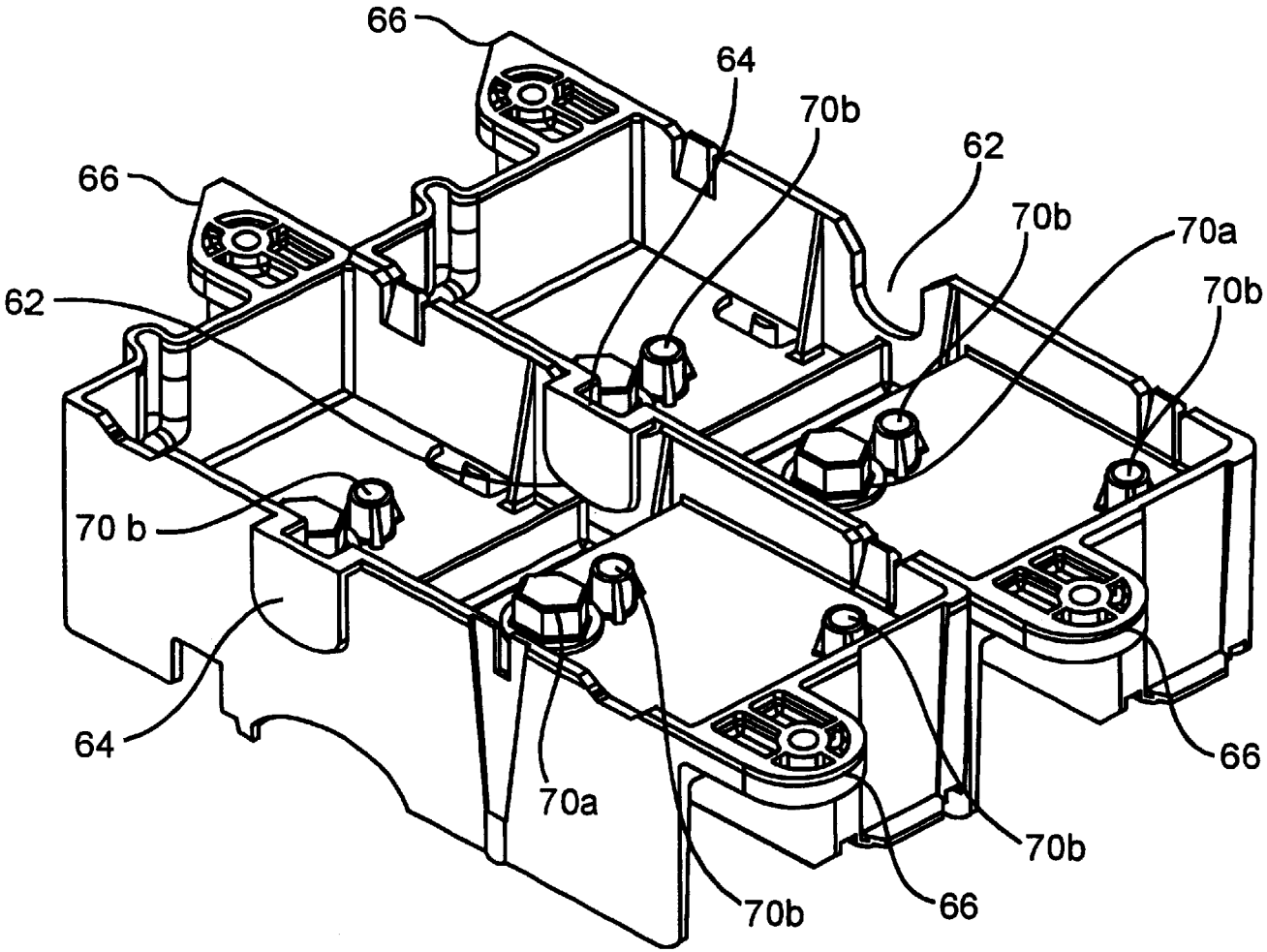
FIG. 8B is a bottom perspective view of the connected base assemblies of FIG. 8A.

As seen in FIG. 7A, the opposing sidewalls 52,53 have an upper notch 60 adjacent a top of the sidewalls 52,53. Additionally, one of the opposing sidewalls 52,53 has a lower notch 62 adjacent a bottom of the sidewalls 52,53, and the other one of the opposing sidewalls 52,53 has a protrusion 64 adjacent a bottom of the sidewall 52,53 (see FIG. 7B). In the illustrated embodiment, the first sidewall 52 has the lower notch 62, and the second sidewall 53 has the protrusion 64. As shown in FIG. 8B, the protrusion 64 of one insulating base 28 mates with the lower notch 62 of an adjacent insulating base 28 to interlock the adjacent bases. Similarly, as shown in FIG. 8A, the upper notch 60 of the adjacent interlocking bases 28 align to create a cradle for the interlocking rotor elements 33. The outer surface of the upper notch 60 also provides a bushing surface for the rotor elements 33 for rotation thereof. Each of the insulating bases 28 also have integral shoulders 66 extending from opposing ends of the bases 28. Each of the shoulders 66 has an aperture therethrough. A screw or other mounting hardware can be inserted through the aperture to secure the insulating base 28 to the enclosure 12. At least one of the insulating bases 28 is secured to the enclosure 12. Then, after one of the bases 28 is secured to the enclosure 12, the remainder of the insulating bases 28 are secured to the respective adjacent base 28 via the lower notch 62 and protrusion 64 connection. In the illustrated embodiment, however, each of the insulating bases are not only connected to each other, but are also secured to the enclosure as described above.

As shown in FIGS. 7A, 7B and 8A, the insulating bases 28 have a plurality of compartments 68*a,* 68*b,* 68*c,* with integral dividing or partition walls thereto. Some of the partition walls are the opposing outside sidewalls 52,53 of the insulating bases. Each of the compartments 68, and specifically the dividing walls including the opposing outside sidewalls 52,53, provides the components in that compartment protection, including arc protection, from components in other compartments, and also provides separation and arc protection from the other phases in adjacent insulating bases. FIGS. 2 and 6B illustrates how the first contact member 36 is located in one of the compartments 68*a,* having three walls thereto. As such, the first contact member 36 is protected and separated from the line terminal 34 which is located in another of the compartments 68*b.* Generally, compartments 68*a,* 68*b* are located on bottom surface 54. The upper compartment 68*c* is located on the upper surface 56, and may contain several elements. As shown in FIG. 6B, the hinge assembly (made of the blade 30, blade hinge member 32, and a spring 37a) and the load terminal 48 are located in compartment 68*c.*

Each of the insulating bases 28 also have a variety of blind mounting holes 70 for securing the components (for example components 32, 34, 36, 38, 40, 48 of FIG. 2) to the insulating base 28. Best seen from the underside view in FIG. 8B in combination with FIGS. 7*a* and 7*b*, the blind mounting holes 70 vary in that some blind mounting holes 70a are configured to receive additional hardware, such as a nut 71, while other blind mounting holes 70b are threaded to receive and secure a screw 73.

Figure 9:
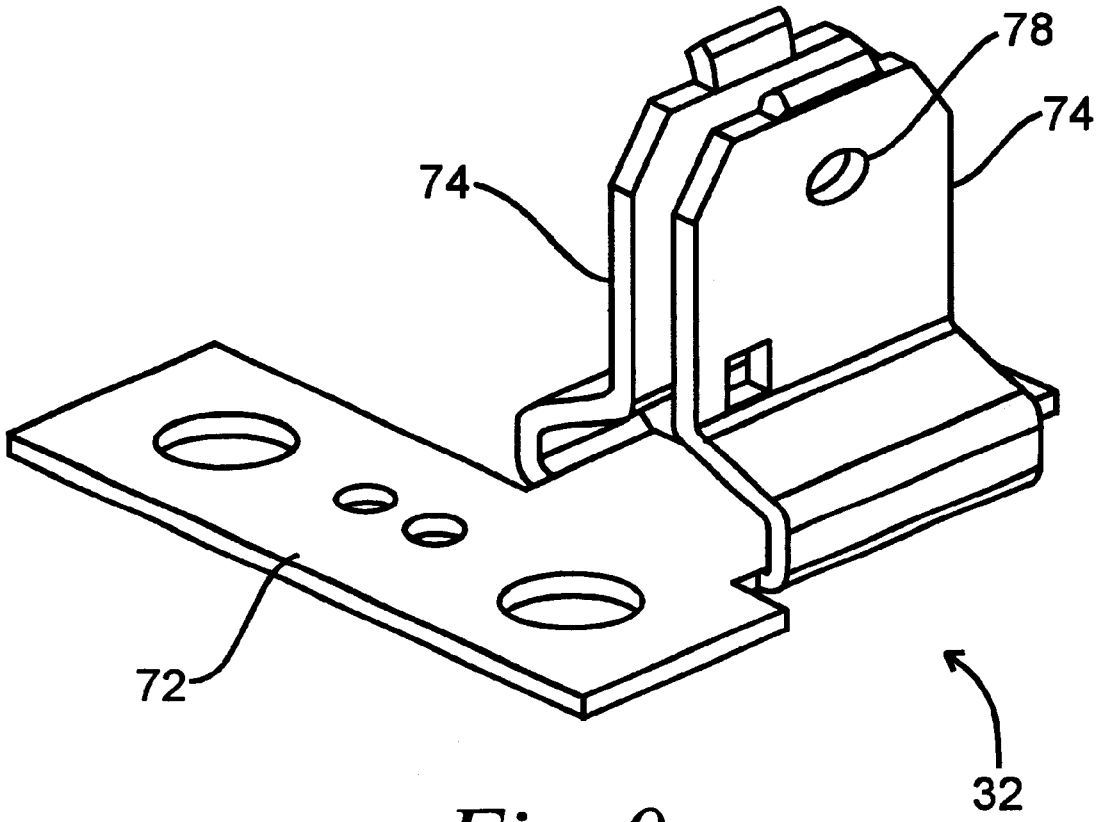
FIG. 9 is a perspective view of the blade hinge member of the present invention.
Figure 13:
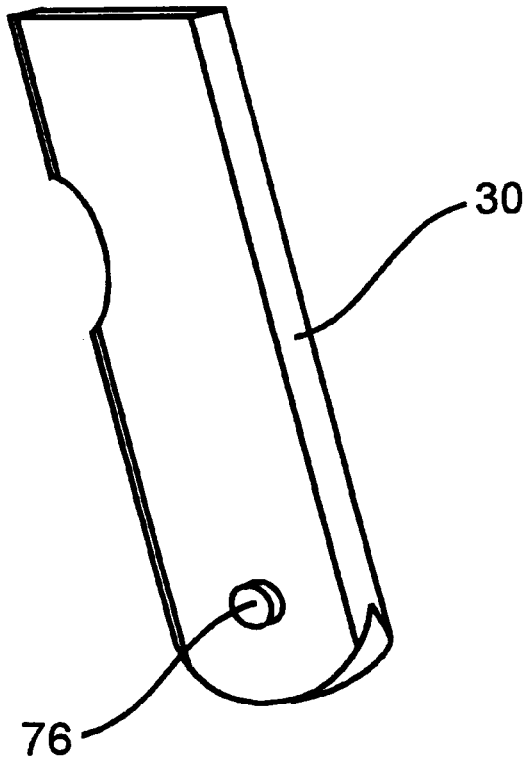
FIG. 13 is a partial exploded perspective view of the blade and hinge assembly of the present invention.
Figure 13:
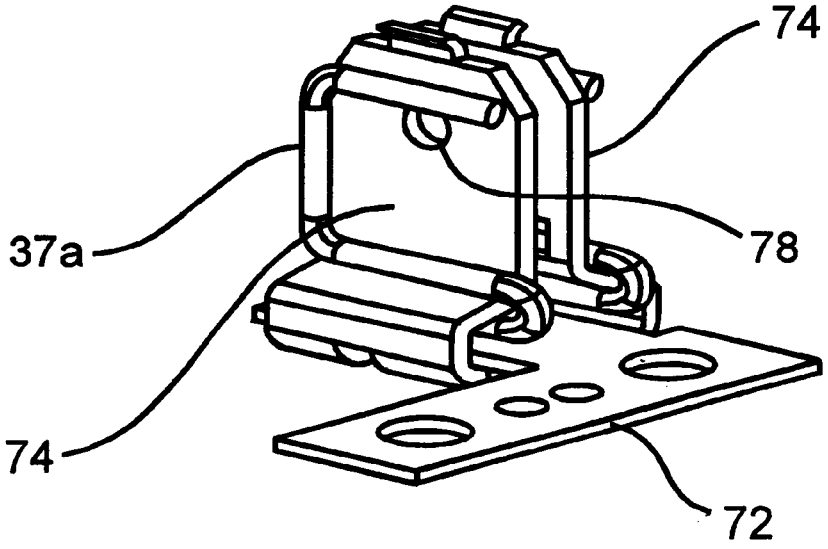
Figure 14:
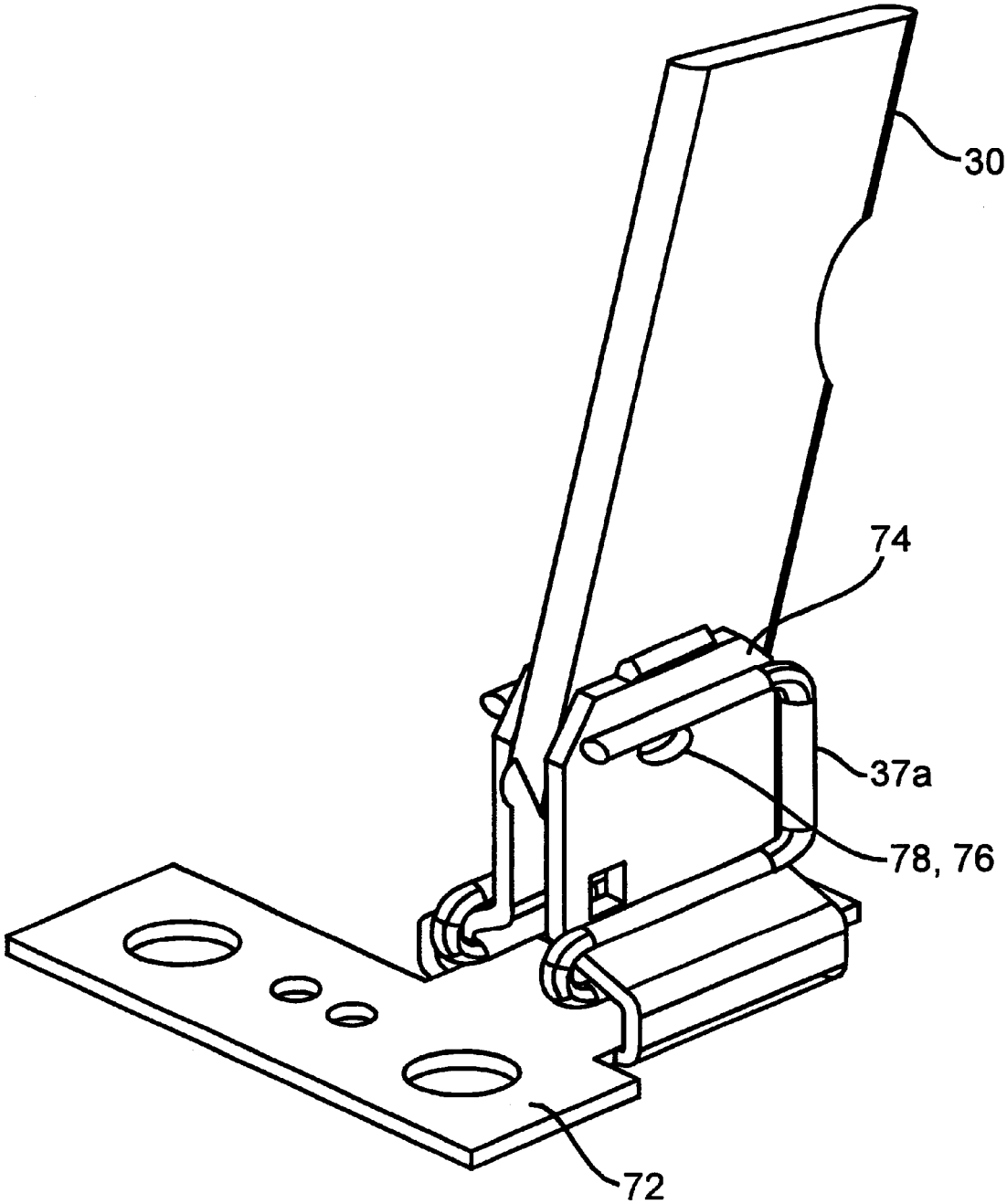
FIG. 14 is a perspective view of the blade and hinge assembly of the present invention.

The blade hinge member 32 and the various contact members (36,38,40) are generally mounted in spaced relation on the insulating base 28 and connect to respective line service for each phase. As shown in FIG. 9, the blade hinge member 32 has a substantially planar bottom wall 72 and opposing sidewalls 74 integral with the bottom wall 72, such that the bottom wall 72 extends from the sidewalls 74. The sidewalls 74 operate as upstanding cantilever spring legs and form a pair of spring jaws for receiving the knife blade 30 between the respective sidewalls 74 as shown in FIGS. 13 and 14. As shown in FIG. 2, the bottom wall 72 of the blade hinge member 32 is provided with apertures 75 for securing directly to the insulating base 28 with screws. At least one of the apertures 75 provides for securing additional components, such as the load terminal 48 or first contact member 36, directly to the blade hinge member 32, without employing additional connecting means. Another of the apertures 75 provides a means for securing the blade hinge member 32 directly to the insulating base 28. The blade hinge member 32 is made of a conductive material. In the illustrated embodiment, the blade hinge member 32 is made from a single integral piece of flat copper sheet metal which is initially formed to the required dimensions and is then bent to the desired shape. In the bent up position the opposing sidewalls 74 are cantilevered up from the bottom wall 72 from an outer exterior position, then bent at an angle toward one another for a distance, and then bent further again in a substantially parallel manner which is also substantially perpendicular to the bottom wall 72. As such, a gap is provided between the opposing sidewalls 74. A distal end of each of the opposing sidewalls is bent at an angle away from the gap to provide a lead in to the gap for insertion of additional components, such as the blade 30 or a fusible member 88.

The knife or switch blade 30 is preferable made of a 3/16" thick piece of copper rawstock which is hardened for wear. As shown in the figures, the blade 30 has a first pivoting member 76 at one end thereof. In the preferred embodiment, the first pivoting member 76 is ¼" diameter protrusion or nub on one side on the blade. This protrusion may be made by indenting the opposite side of the blade to deform the material, thereby achieving the protrusion on the required side. In the preferred embodiment the blade 30 is hardened to a Rockwell hardness of F86-93 and is then plated.

The sidewalls 74 of the blade hinge member 32 have a second pivoting member 78 adjacent a top end thereof which defines a pivot position. In the preferred embodiment, the second pivoting member 78 is an aperture in the sidewall 74 of the blade hinge member 32. However, the second pivoting member 78 may be an indentation or any other element capable of engaging and mating with the first pivoting member 76 of the blade 30. Additionally, in the preferred embodiment, both opposing sidewalls 74 of the blade hinge member 32 have second pivoting members 78. While only one is necessary, having second pivoting member 78 is each sidewall 74 allows for multiple configurations of the blade hinge member 32, and also eases assembly. The blade is inserted in the gap between the opposing sidewalls 74 of the blade hinge member 32 and the first pivoting member 76 on the blade 30 mates with the second pivoting member 78 of the blade hinge member 32 to allow for rotation of the blade 30 about the pivot position.

Figure 11:
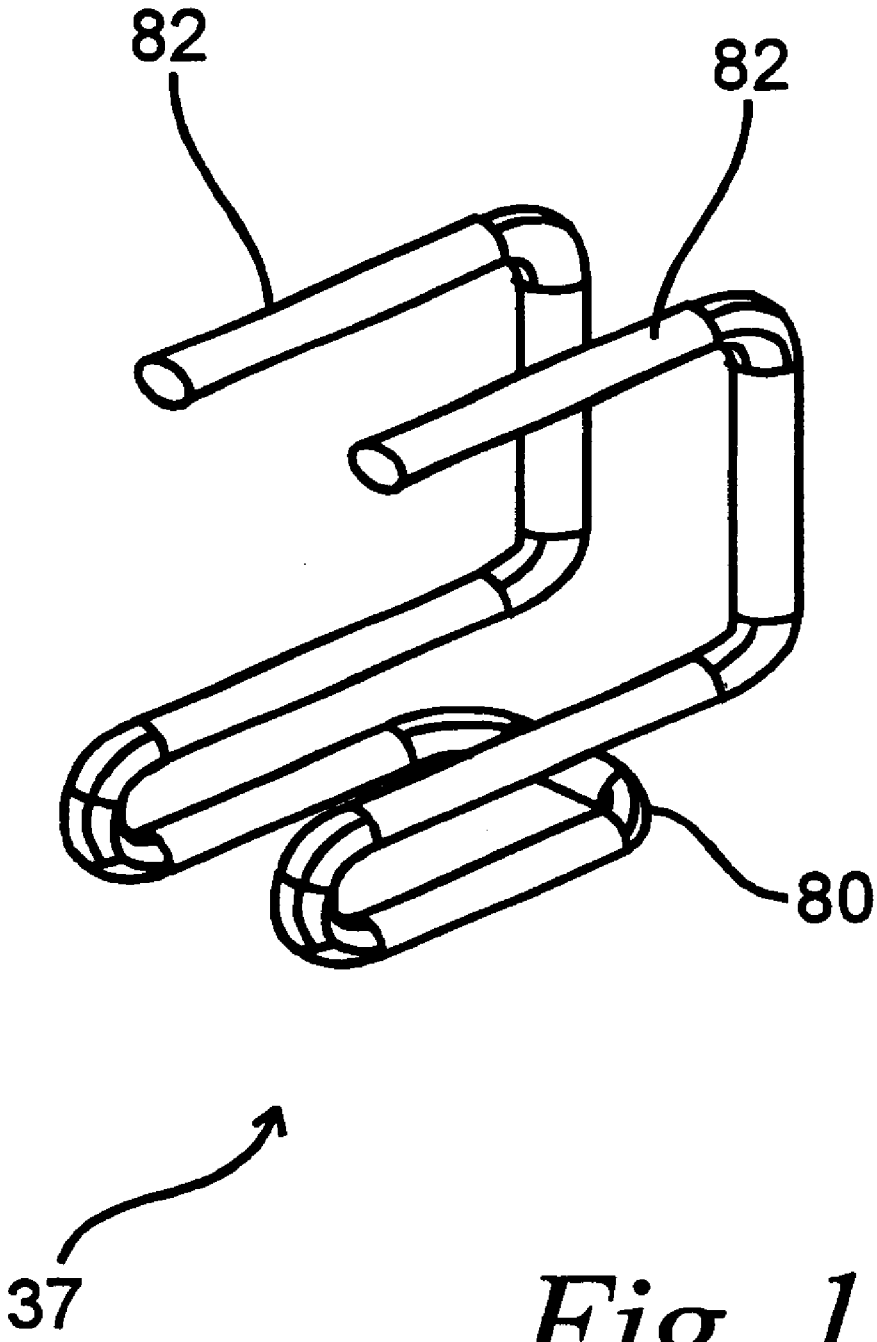
FIG. 11 is a perspective view of the spring member of the present invention.

As shown in FIGS. 13 and 14, a first spring clip 37*a* is removably connected to the blade hinge member 32 to assist in retaining the blade 30 to the blade hinge member 32. The first spring clip 37*a* is also illustrated in FIG. 11. The spring clip 37*a* comprises a formed element made of a single piece of music wire that is bent up. In its configuration, the spring clip 37*a* has a tongue 80 and opposing side members 82. The tongue 80 is dimensioned to fit in the area between the opposing sidewalls 74 of the blade hinge member 32, and more specifically between the area where the opposing sidewalls 74 are bent at an angle toward one another from the outer exterior position to the position where they extend in a substantially parallel manner. With the tongue 80 is in position, the side members 82 contact the outer side of the opposing sidewalls 74, respectively. During manufacturing, the opposing side members 82 of the spring clip 37*a* are bent at an angle toward each other resulting in approximately a 0.13" clearance between the top portions of the opposing side members 82. Thus, the side members 82 of the spring clip 37*a* provide reinforcement for the sidewalls 74 to not only prevent excessive bending of the sidewalls 74 when the blade 30 is inserted between the sidewalls 74, but additionally to provide a force to assist in retaining the nub of the first pivoting member 76 within the aperture of the second pivoting member 78.

Figure 10:
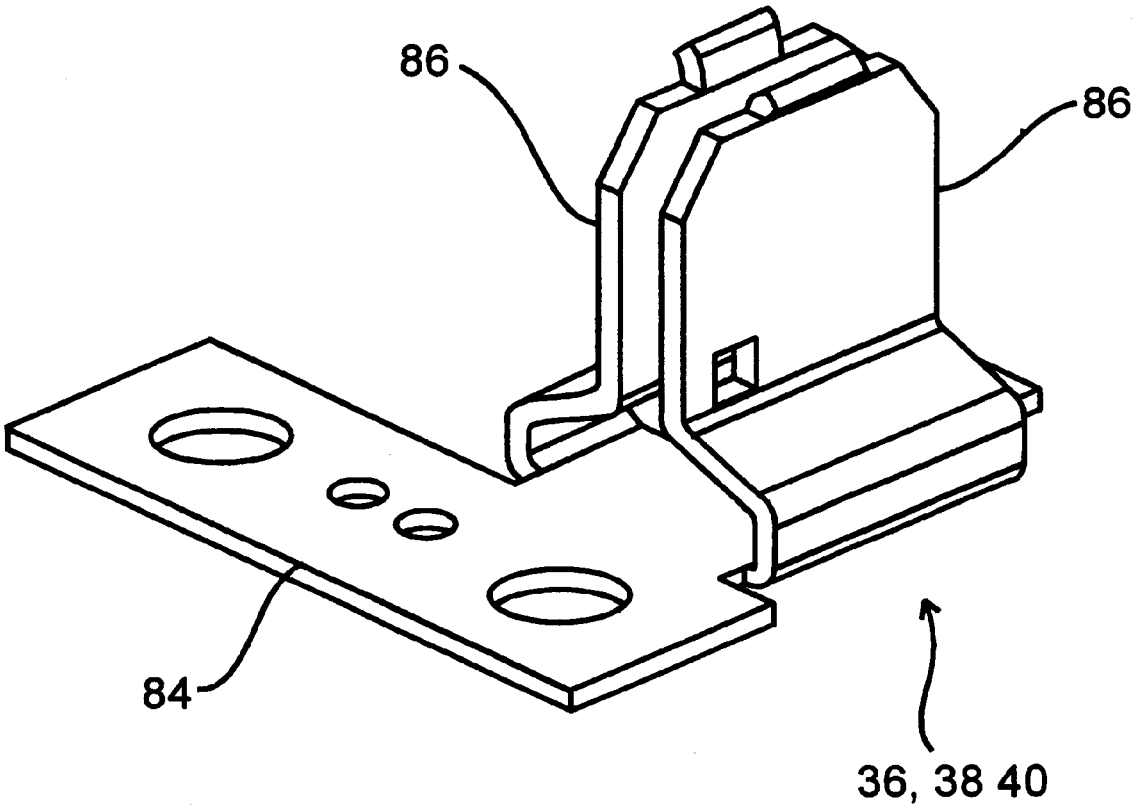
FIG. 10 is a perspective view of the first contact member of the present invention.

The first contact member 36 is illustrated in FIG. 10, and has a substantially planar bottom portion 84 and opposing sidewalls 86 integral with the bottom portion 84. The first contact member 36 is located in one of the compartments 68*a* of the insulating base 28. As shown in FIGS. 2 and 6B, the bottom portion 84 of the first contact member 36 extends from the sidewalls 86 and is adapted to be secured to the insulating base 28. As shown in FIGS. 6A and 6B, the opposing sidewalls 86 of the first contact member 36 operate as upstanding cantilever spring legs and form a pair of spring jaws for receiving the knife blade 30 between the respective sidewalls 86 to electrically engage and disengage the blade 30 in response to pivoting movement of the blade 30.

Like the blade hinge member 32, the first contact member 36 is made from a single integral piece of flat copper sheet metal which is initially formed to the required dimensions and is then bent to the desired shape. The shape of the sidewalls 86 of the first contact member 36 are substantially similar to the shape of the sidewalls 74 of the blade hinge member 32. As such, the opposing sidewalls 86 are cantilevered up from the bottom portion 84 from an outer exterior position, then bent at an angle toward one another for a distance, and then bent further again in a substantially parallel manner which is also substantially perpendicular to the bottom portion 84. Thus, a gap is provided between the opposing sidewalls 86. And, a distal end of each of the opposing sidewalls 86 is bent at an angle away from the gap to provide a lead-in to the gap for insertion of additional components like the blade 30 or a fusible member 44.

A second spring clip 37*b,* illustrated in FIGS. 11 and 6A, is removably connected to the first contact member 36 to assist in engaging the blade 30 when the blade 30 is rotated to the first contact member. The second spring clip 37*b* is geometrically identical to the first spring clip 37*a* utilized with the blade hinge member 32. In one embodiment, the second spring clip 37*b* is identical to the first spring clip 37*a*. As with the first spring clip, the second spring clip 37*b* has a tongue 80 and opposing side members 82. The tongue 80 is dimensioned to fit in the area between the opposing sidewalls 86 of the first contact member 36, and more specifically between the area where the opposing sidewalls 86 are bent at an angle toward one another from the outer exterior position to the position where they extend in a substantially parallel manner. With the tongue 80 in position, the side members 82 contact the outer side of the opposing sidewalls 86, respectively. The side members 82 of the spring clip 37*b* provide reinforcement for the sidewalls 86 to prevent excessive bending of the sidewalls 86 when the blade 30 is inserted between the sidewalls 86.

The line terminal 34 directly contacts the bottom portion 84 of the first contact member 36 to provide electrical communication therewith. As shown in FIG. 2, the line terminal 34 is secured to the bottom portion 84 of the first contact member 36 to eliminate connection pieces and to also to eliminate additional mounting hardware.

Figure 3:
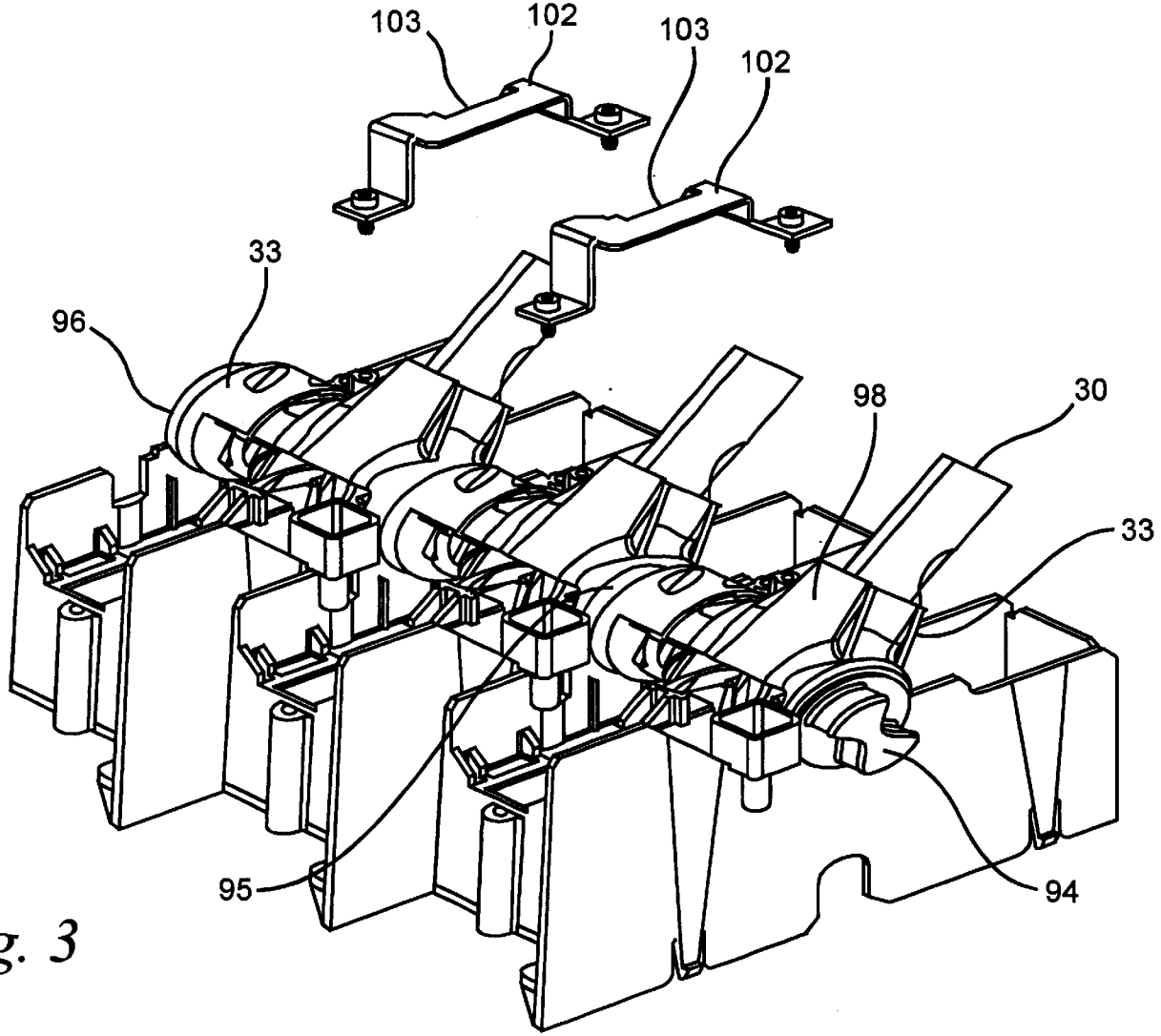
FIG. 3 is a perspective view of a three-pole switch assembly of the present invention.
Figure 15A:
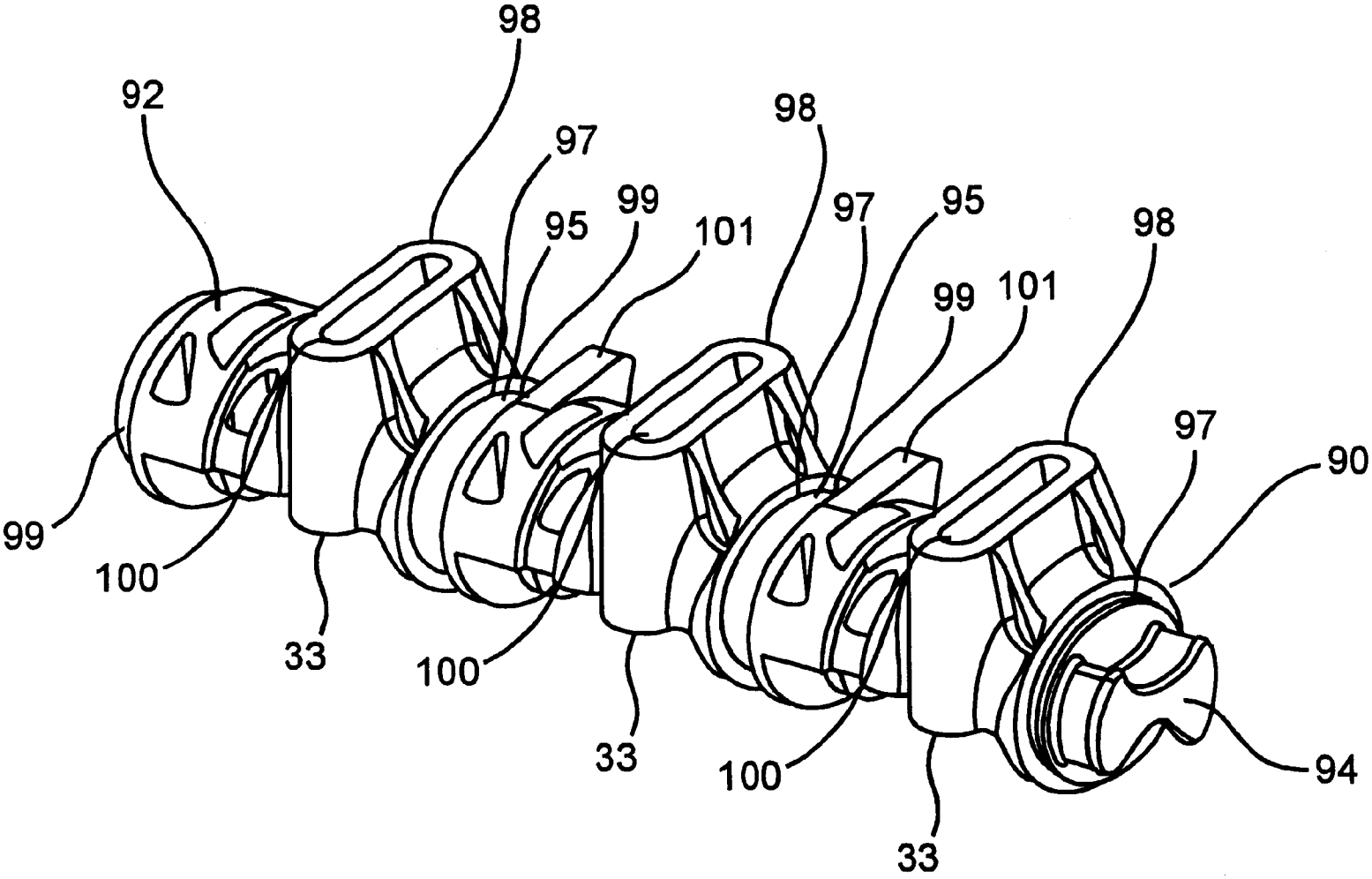
FIG. 15A is a front perspective view of the rotor of the present invention.
Figure 15B:
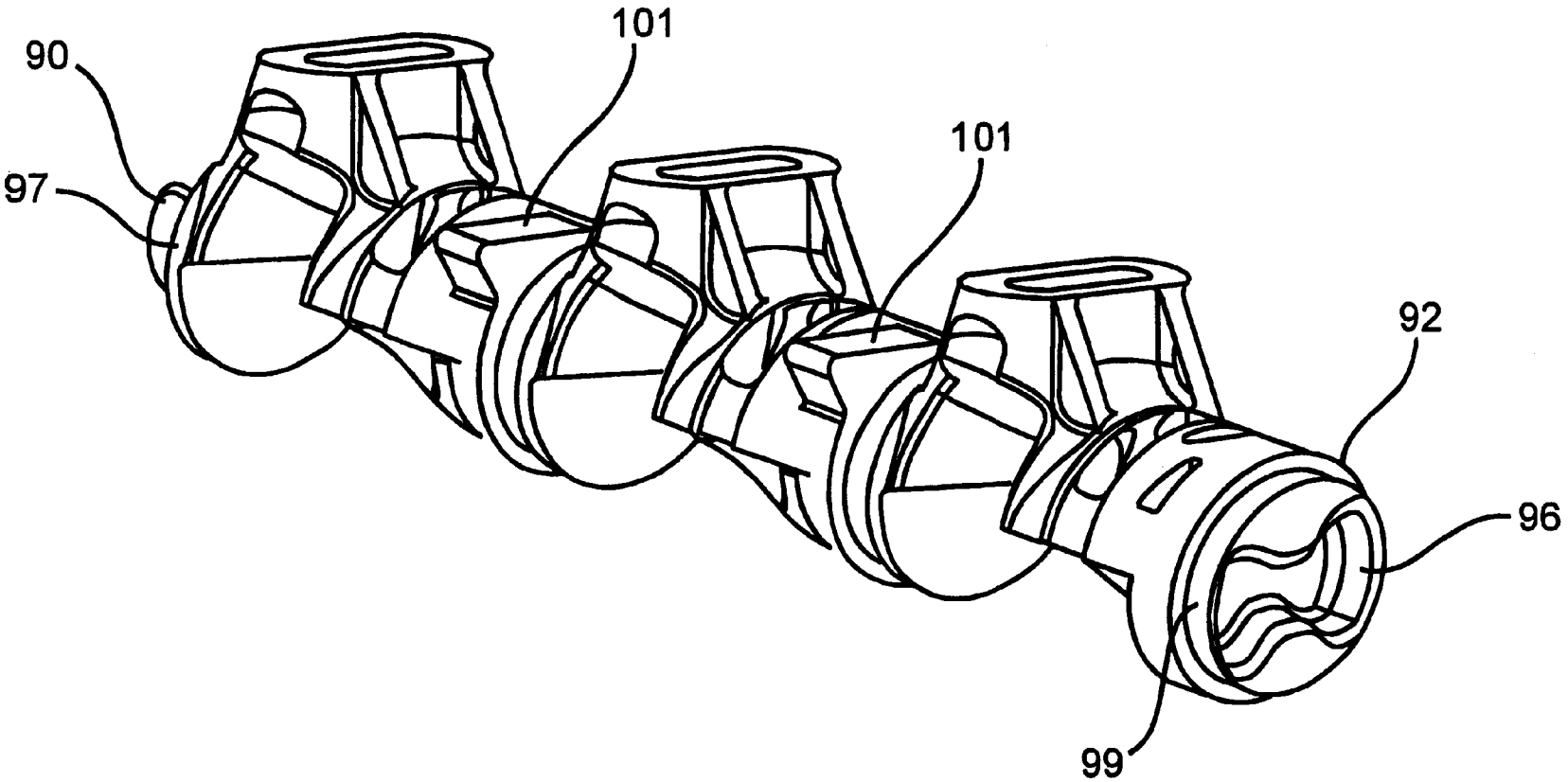
FIG. 15B is a rear perspective view of the rotor of the present invention.

A rotor element 33 is utilized in the assembly to rotate the blade 30 about the pivot position. The rotor element 33 is made of an insulating material, including Cyglas 620M. As shown in FIGS. 15A and 15B, the rotor element 33 has a first end 90 and a second end 92. The first end 90 of the rotor element has an integral geometric protrusion or boss 94 extending therefrom, and the second end 92 of the rotor element has an indentation or pocket 96. The protrusion 94 is shaped like a "dog bone" and extends approximately 0.375" outwardly from the first end 90 of the rotor. The indentation 96 is similarly shaped like a "dog bone" and extends approximately 0.400" inward from the second end 92 of the rotor. The protrusion 94 of the first end 90 is dimensioned to mate with the indentation 96 of a second end 92 of an adjacent rotor element 33. As shown in FIG. 3, the rotor element 33 has a hub element 95 that is adapted to rotate about the upper notch 60 of the insulating base 28. The hub element 95 is partially formed from a narrower first hub member 97 adjacent the first end of the rotor element, and a wider second hub member 99 adjacent the second end of the rotor element. As such, when adjacent rotor elements 33 are connected at the respective first and second ends 90,92, the hub 95 is created. The hub 95 has an outer bushing surface to engage the upper notch of the insulating base. The rotor element 33 also has an integral sleeve 98 transverse to the axis of the rotor element 33. The sleeve 98 has an slotted aperture 100 therethrough to engage the blade 30. Specifically, the blade 30 slides through the aperture 100 of the sleeve 98 and is held in place by the sleeve. The rotor element 33 additionally has a flat 101 adjacent the second end 92 of the rotor 33, but inward of the wider second hub member 99. Once the blade 30 is retained within the sleeve 98, the rotor is placed on the upper notch 60 and is secured in place by a rotor hold down bracket 102.

Like the rotor element 33, the rotor hold down bracket 102 has a flat portion 103 which engages the flat 101 area of the rotor element 33 upon rotation thereof. As shown in FIG. 3, the flat 103 on the rotor hold down bracket 102 limits rotation of the rotor element 33 in one direction. In the preferred embodiment, the bracket 102 prevents the rotor element 33 from rotating substantially greater than 45° from the position when the blade 30 engages the first contact member 36. Thus, the rotor element 33 does not contact the swinging cover 14 of the enclosure 12 when rotated.

In use, the handle 16 outside the enclosure is moved between the "ON" and "OFF" positions as desired by the user. During the movement of the handle from one position to the other, the switching mechanism 22 (described in detail below) operates to quickly store and release energy to rotate the rotor 33. The switching mechanism 22 has a component that engages the protrusion 94 of the first end 90 of the rotor element 33. Thus, when the switching mechanism 22 releases its energy the rotor element 33 is rotated, which in turn rotates the blade 30 about the pivot position to engage and disengage, respectively, the blade 30 from the first contact member 36.

Depending on whether a fusible or a non-fusible switching assembly is to be employed, a variety of additional components are added to the above described switch assembly. In a non-fusible switching assembly 26, as shown in FIG. 6B, a load terminal 48 is utilized. The load terminal 48 directly contacts and is secured to the bottom wall 72 of the blade hinge member 32. No additional connecting members are required.

In a fusible switching assembly 24, as shown in FIG. 6A, a second contact member 38, third contact member 40, second insulating base 42, fusible member 44, and load terminal 48 are required. The second contact member 38 and third contact member 40 are geometrically identical to the first contact member 36 illustrated in FIG. 10. As such, like reference numerals will be employed to describe the second and third contact members 38, 40. In the fusible switching assembly 24, the substantially planar bottom portion 84 of the second contact member 38 contacts and is secured to the bottom wall 72 of the blade hinge member 32. No additional connecting members are required. The opposing sidewalls 86 of the second contact member 38 removably secure a first portion of the fusible member 44 thereto. A third spring clip 37*c* is removably connected to the second contact member 38 to assist in securing the first end of the fusible member 44 to the second contact member 38. The third spring clip 37*c* is geometrically identical to the first and second spring clips 37*a,* 37*b*. The only potential difference between the first spring clip 37*a,* and the second and third spring clips 37*b,*37*c* is the diameter of music wire utilized to manufacture the spring clip.

Figure 16A:
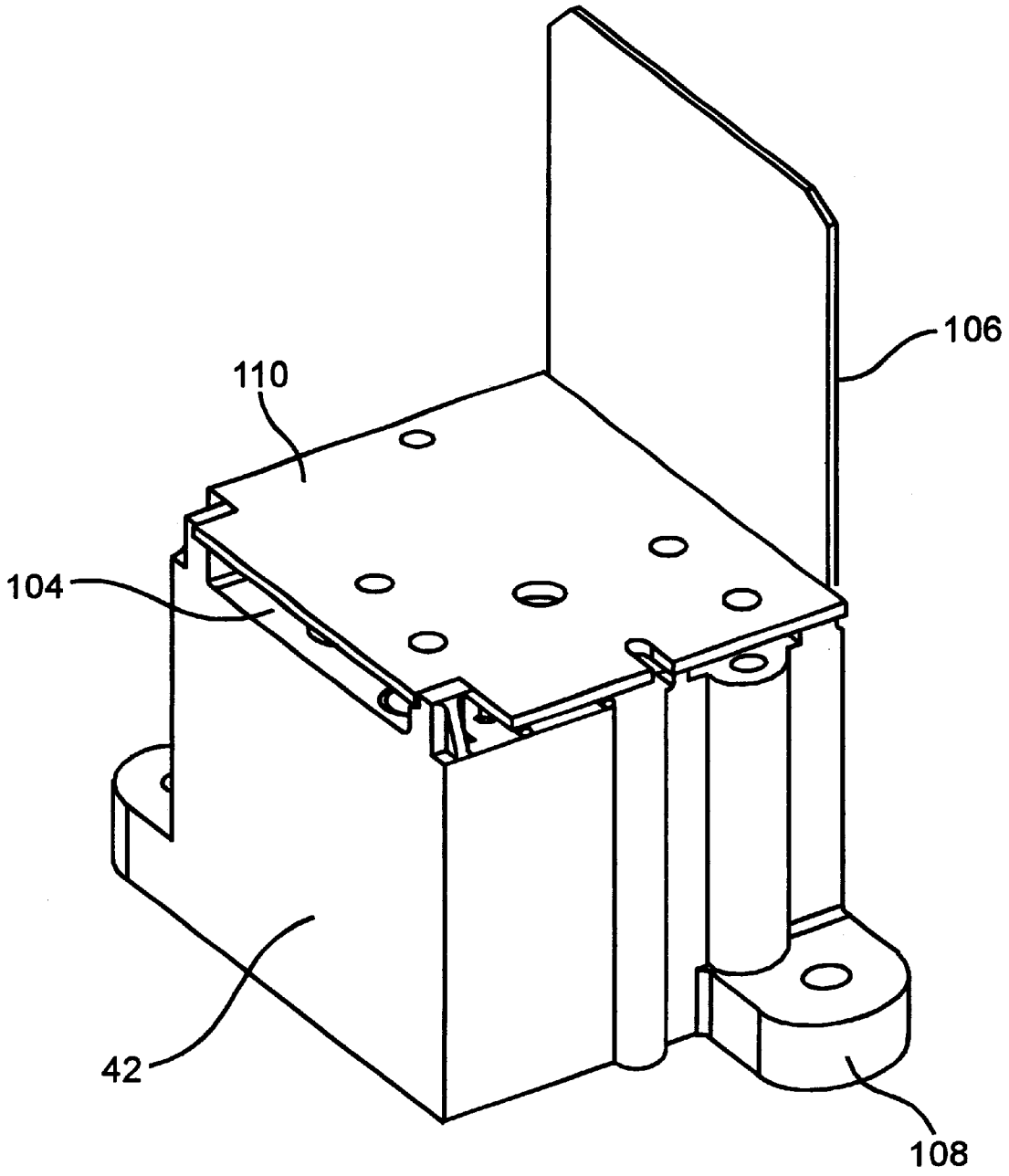
FIG. 16A is a perspective view of the second insulating base of the present invention.
Figure 16B:
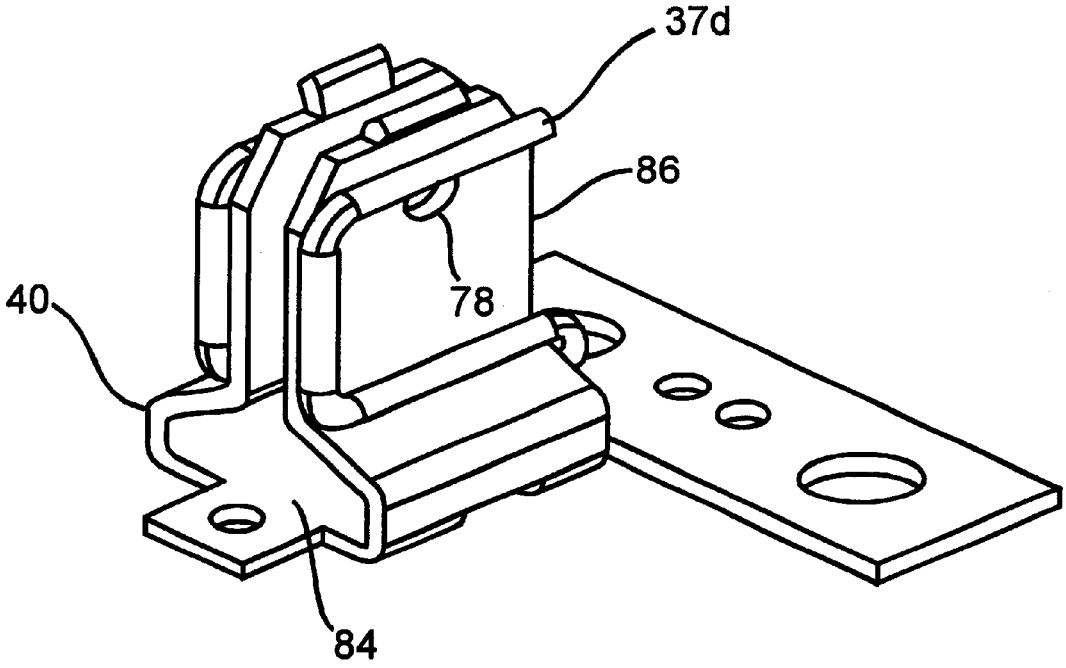
FIG. 16B is an exploded view of another embodiment of the second insulating base of the present invention.
Figure 16B:
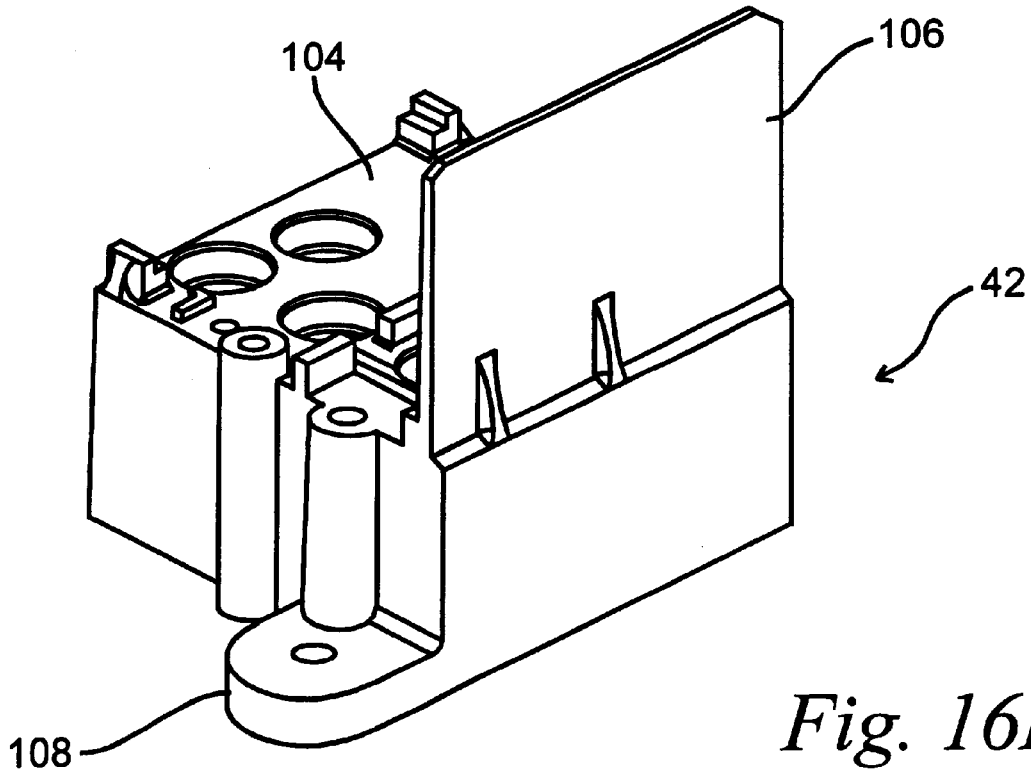

The second insulating base 42 can be utilized as either a load base or a neutral base, depending on the configuration as shown in FIGS. 6A, 16A, and 16B. Each phase of the circuit connects a load line to a respective load terminal. Like the first insulating base, the second insulating base 42 is integrally formed of an electrically insulating material, such as a thermoplastic sold by the General Electric Company under the tradename Valox. The second insulating base 42 has a bottom surface 104 and an arc-suppressing sidewall 106 integral therewith. In a preferred embodiment, the sidewall 106 of the second insulating base 42 extends a distance above the bottom surface 104 of the base 42, and further extends a distance above any components connected to the base 42. Each of the second insulating bases 42 has integral shoulders 108 extending from the opposing ends of the bases 42. And, each of the shoulders 108 has an aperture therethrough. A screw or other mounting hardware can be inserted through the aperture to secure the second insulating base 42 to the enclosure 12. Generally, each second insulating base 42 is separately secured to the enclosure 12 and is not attached to adjacent second insulating bases 42, however, they may be secured to each other with similar means as the first insulating base 28. Generally, a majority of the bottom surface 104 of the second insulating base 42 is contained on the same plane, which is different from the first insulating base 28. The bottom surface 104 of the second insulating base 42 has a plurality of apertures, including threaded, non-threaded, and geometric apertures, similar to the first insulating base 28, to provide for configuring and securing a variety of components thereto in a variety of arrangements. These apertures also provide for securing a base plate 110 to the second insulating base necessary for creating a neutral base.

In a fusible switch assembly 24 illustrated in FIG. 16B, the substantially planar bottom portion 84 of third contact member 40 is secured to the second insulating base 42. The opposing sidewalls 86 of the third contact member 40 removably secure a second portion of the fusible member 44 to electrically connect the second contact member 38 with the third contact member 40. A fourth spring clip 37*d* is removably connected to the third contact member 40 to assist in securing the second end of the fusible member 44 to the third contact member 40. The fourth spring clip 37*d* is geometrically identical to each of the first, second, and third spring clips 37*a,* 37*b,* 37*c*. And in the preferred embodiment, the second spring clip 37*b,* third spring clip 37*c,* and fourth spring clip 37*d* are identical components. The only potential difference between the first spring clip 37*a,* and the second, third, and fourth spring clips 37*b,*37*c,* 37*d* is the diameter of music wire utilized to manufacture the spring clip.

In the illustrated embodiment, the first contact member 34, second contact member 38, and third contact member 40 are substantially identical components. This permits three unique components to be replaced by one unique component. Moreover, at least one of the opposing sidewalls 86 of the first, second and third contact members 36,38,40 has a second pivoting member 78 at a pivot position thereof, similar to the second pivoting member 78 of the blade hinge member 32. The second pivoting member 78 of the first, second, and third contact members 36,38,40 is adapted to mate with the first pivoting member 76 of the blade 30 to allow for rotation of the blade 30 about the pivot position thereof. As such, the opposing sidewalls 86 of the first, second, and third contact members 36,38,40 are adapted to: (1) engage and disengage the blade 30, (2) mate with the blade 30 to allow for rotation of the blade 30 about a pivot position of the contact member 36,38,40, and (3) separately removably secure a fusible member 44 thereto. Similarly, the opposing sidewalls 74 of the blade hinge member 32 are adapted to: (1) engage and disengage the blade 30, (2) mate with the blade 30 to allow for rotation of the blade 30 about a pivot position thereof, and (3) separately removably secure a fusible member 44 thereto. Thus, the blade hinge member 32 and the first, second, and third contact members 36,38,40 are directly interchangeable and substantially identical components. Each component 32,36,38,40 has a substantially planar bottom portion 84 or bottom wall 72, respectively, extending from and integral with opposing sidewalls 74,86. Further, each component 32,34,36,38 has a second pivoting member 78 adjacent a top end of the sidewalls 74,86 which mates with a first pivoting member 76 on the blade 30. Accordingly, one single component can be utilized as the blade hinge member 32, the first contact member 36, the second contact member 38, and the third contact member 40. Thus, what was once four separate components has now been pared down to one universal component.

Additionally, in one embodiment the bottom wall 72 of the blade hinge member 32 and the bottom portion 84 of the first, second and third contact members 36,38,40 have corresponding positioning members to the protrusions or positioning members 58 of the first and second insulating bases 28,42.

The fusible member 44 is generally a H-class, R-class, or J-class fuse having blade-shaped contacting ends and being rated generally between 60-amp and 100-amp. The different rated fuses have different sizes, and most specifically have different lengths. Because the second insulating base 42 is separate from the first insulating base 28, the second insulating base 42 of any phase can be moved in the enclosure 12 to accommodate various sizes of fuses. For this reason, and because the switch assemblies 24 utilize contact members 36,38,40 and blade hinge member 32 that are capable of engaging a variety of size of fuse blade elements, multiple fuses having a different rating and/or class can be used in the same switching assembly 24.

Finally, the load terminal 48 directly contacts and is secured to the bottom portion 84 of the third contact member 38. No additional connecting members are required.

Figure 4:
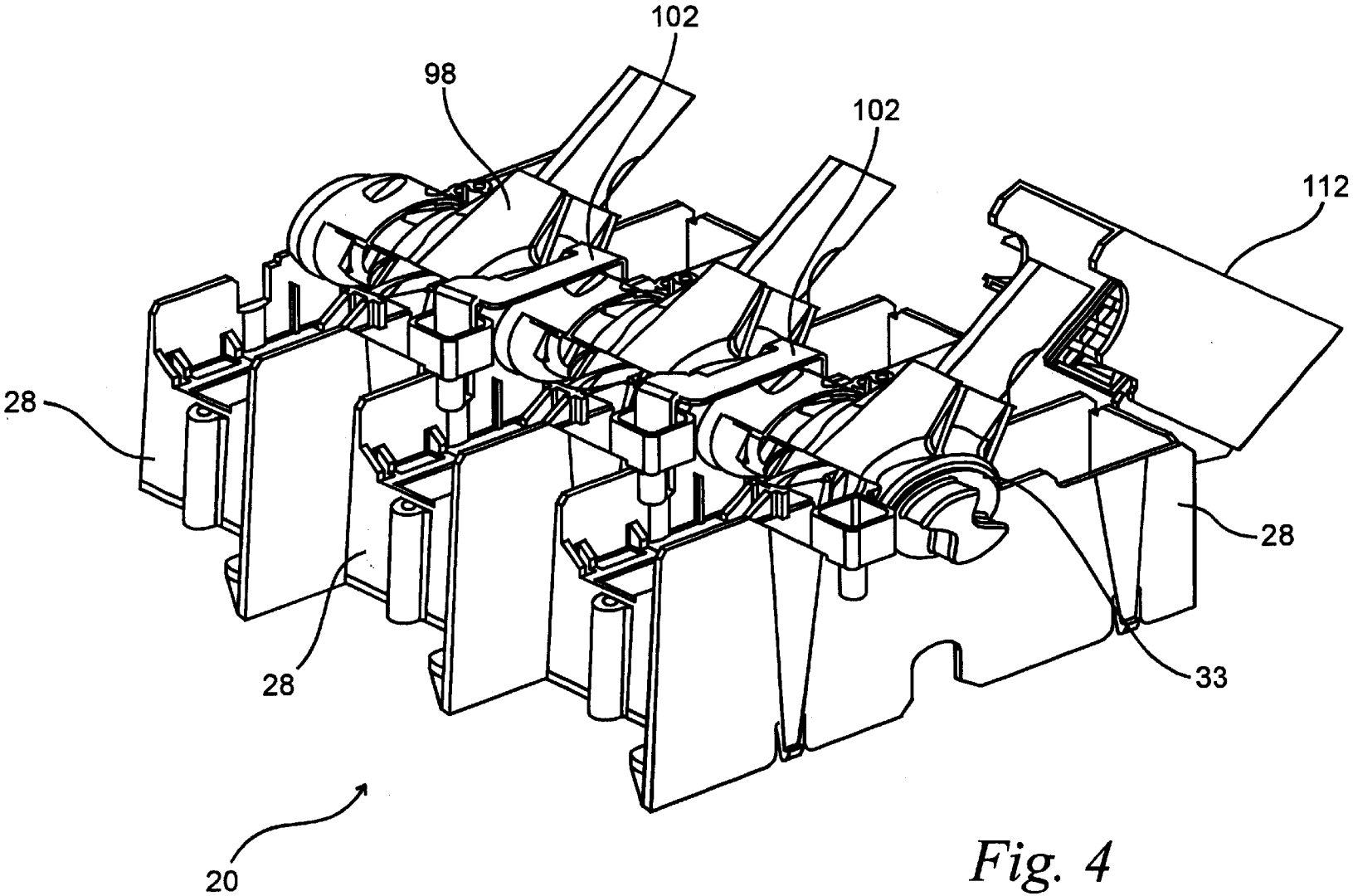
FIG. 4 is a rear perspective view of the three-pole switch assembly of FIG. 4 with an arc-suppressing housing.
Figure 5:
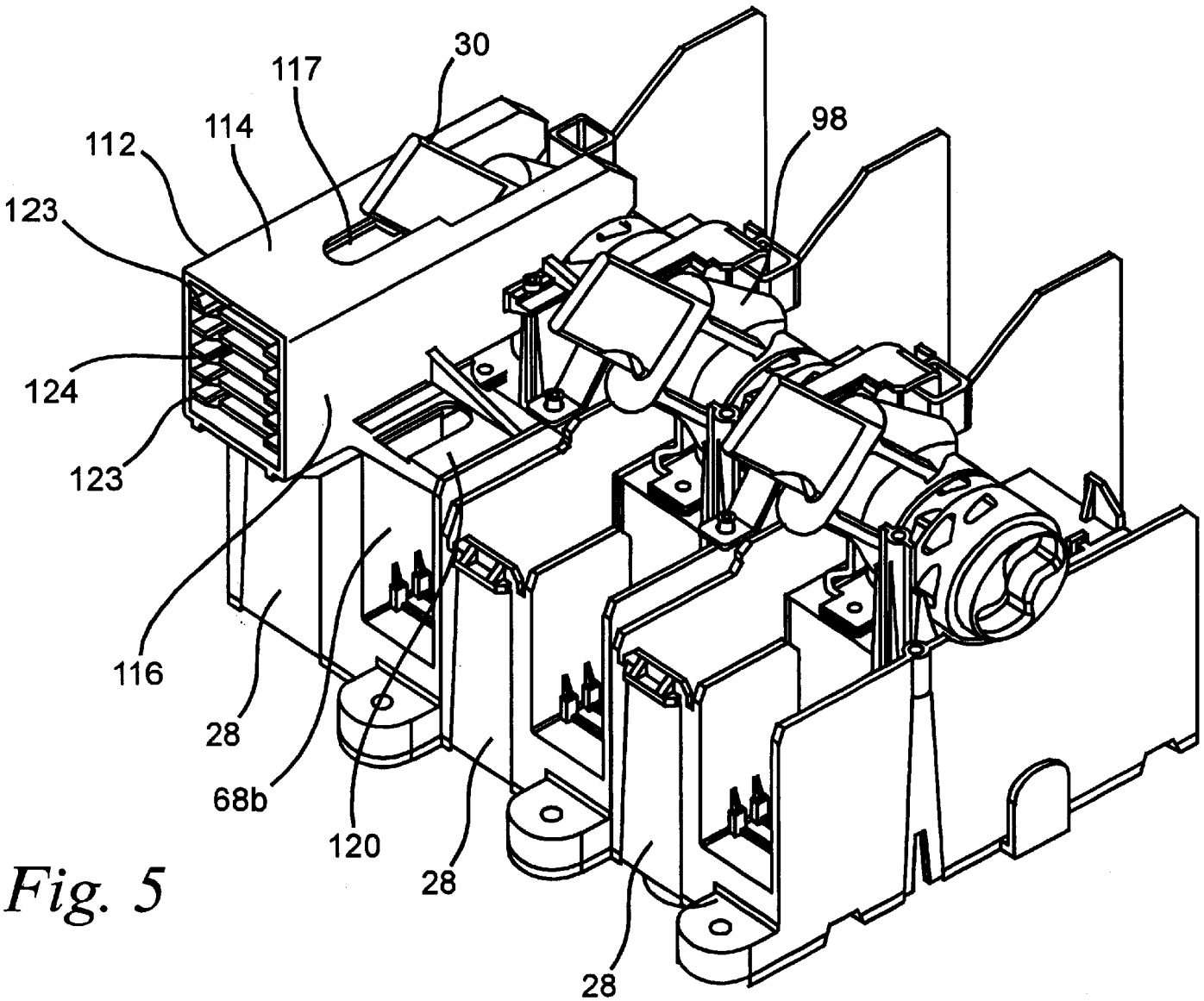
FIG. 5 is a front perspective view of the three-pole switch assembly of FIG. 4.
Figure 12:
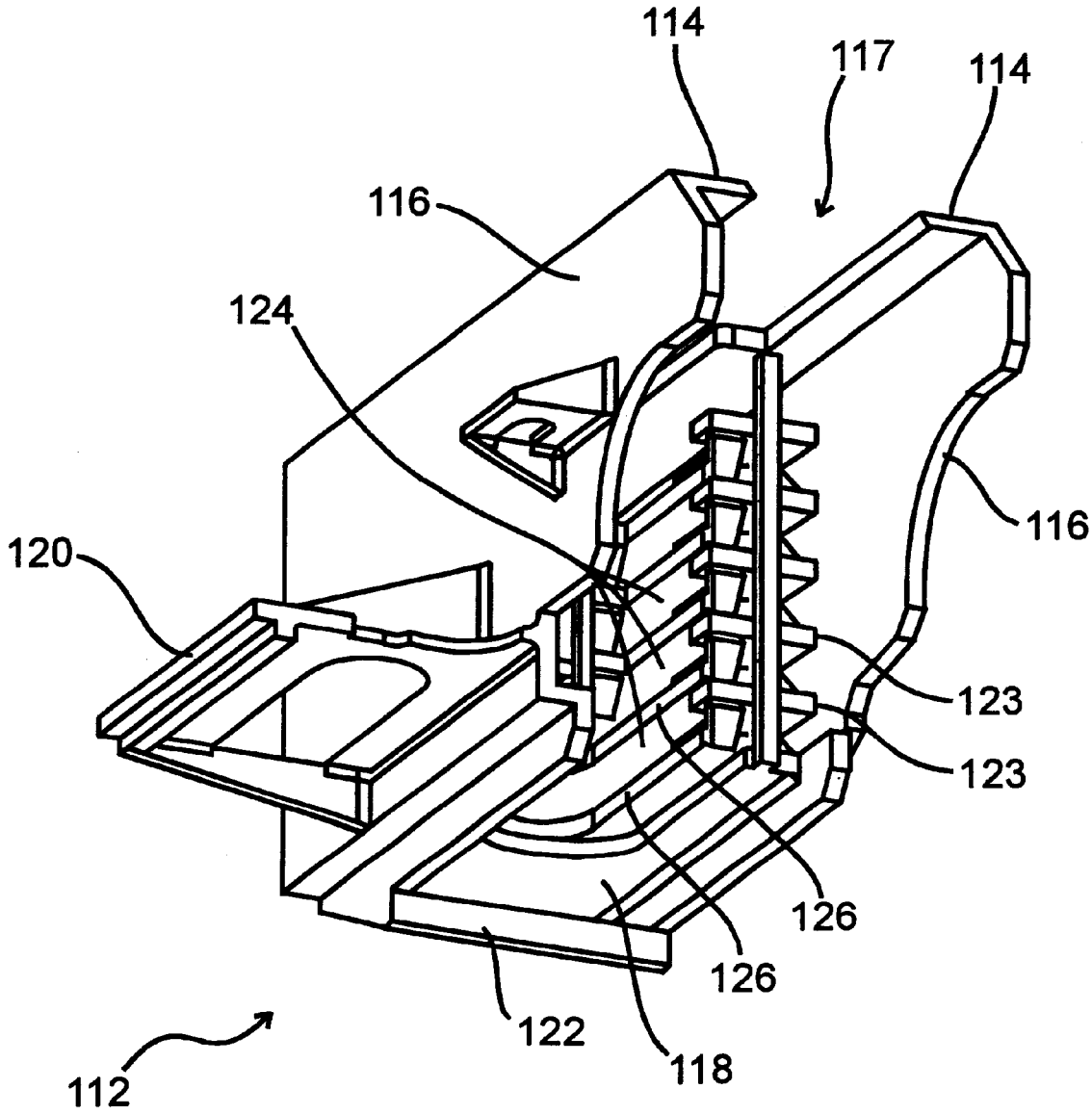
FIG. 12 is a partial perspective view of the arc suppressing housing of the present invention.

As shown in FIGS. 4 and 5, the switch assembly 20 further comprises an arc suppressing housing 112 that removably connects to the insulating base 28. The arc suppressing housing is illustrated in detail in FIG. 12. The arc suppressing housing 112 has a top wall 114, opposing sidewalls 116 extending from the top wall 114, and a bottom member 118 connecting the sidewalls 116 at a bottom thereof. The top wall 114 has a longitudinal notch 117 to allow the blade 30 and sleeve member 98 of the rotor 33 to freely rotate and pass therethrough. As best viewed in FIG. 12, a protrusion 122 extends from the bottom member 118. The protrusion 122 has a means for engaging and connecting to the front wall of the insulating base 28. After the housing is connected to the insulating base 28 by its protrusion 122, the housing 112 is free to rotate from its position in FIG. 4 to its position in FIG. 5 to fully cover the components in that compartment 68*a*. As shown in FIG. 5, a transverse member 120 depends from one of the sidewalls 116 of the housing 112. When the arc suppressing housing 112 is connected to the insulating base 28, the transverse member 120 extends over the compartment 68*b* housing the line terminal 34 to partially cover the line terminal 34.

Additionally, the arc suppressing housing 112 has a plurality of positioning members 123 between the opposing walls 116 thereof. Arc suppressing plates 124 extend through the opening at the end of the housing 112 and are seated on the positioning members 123. The arc suppressing plates 124 have a slot 126 to allow the blade 30 to pass through to engage the first contact member 36. The arc suppressing assembly effectively surrounds the blade 30, first contact member 36 and line terminal 34 to quench the arc released when the knife blade 30 engages or disengages the first contact member 36 and to protect the other components in the switch assembly 20.

As explained above, the switch 10 described herein is capable of being utilized at least for a two-, three-, four-, or six-phase circuit. If more than one-phase is required, a plurality of switching assemblies 20 are required. For each phase required, a separate switching assembly 20 is added to the interior of the enclosure 12.

For example, with a three-phase circuit, three adjacent insulating bases 28, and all components connected thereto, would be utilized. They are generally mounted adjacent each other and connected to respective line service for each phase. The insulating bases 28 are interlocked with their respective protrusions 64 and lower notches 62 as explained above. When the insulating bases 28 are connected, the upper notches 60 align to form a means for retaining a rotor made of at least three connected rotor elements 33. Additionally, each separate insulating base 28 has a respective blade hinge member 32, blade 30, first contact member 36, line terminal 34, and rotor element 33. The adjacent rotor elements 33 are connected via their protrusions 94 and indentations 96 as explained above. Rotating the connected rotor elements 33 causes each respective knife blade 30 to simultaneously engage or disengage the respective first contact members 36.

Depending on whether the switch assembly 20 is to be fusible or non-fusible, additional components for each respective phase are added as explained above. Further, the switch assembly 20 is capable of being modified from a fusible switch 24 to a non-fusible switch 26. If a fusible switch 24 is being employed and a non-fusible switch 26 is desired, the second contact member 38 is replaced with a load terminal 48 contacting the bottom wall 72 of the respective blade hinge member 32. If a non-fusible switch 26 is being employed and a fusible switch 24 is desired, the load terminal 48 is replaced with a second contact member 38 contacting the bottom wall 72 of the respective blade hinge member 32. Further, a fusible member 44 is added and a second insulating base 42 having a third contact member 40 and a load terminal 48 are also added.

Figure 17:
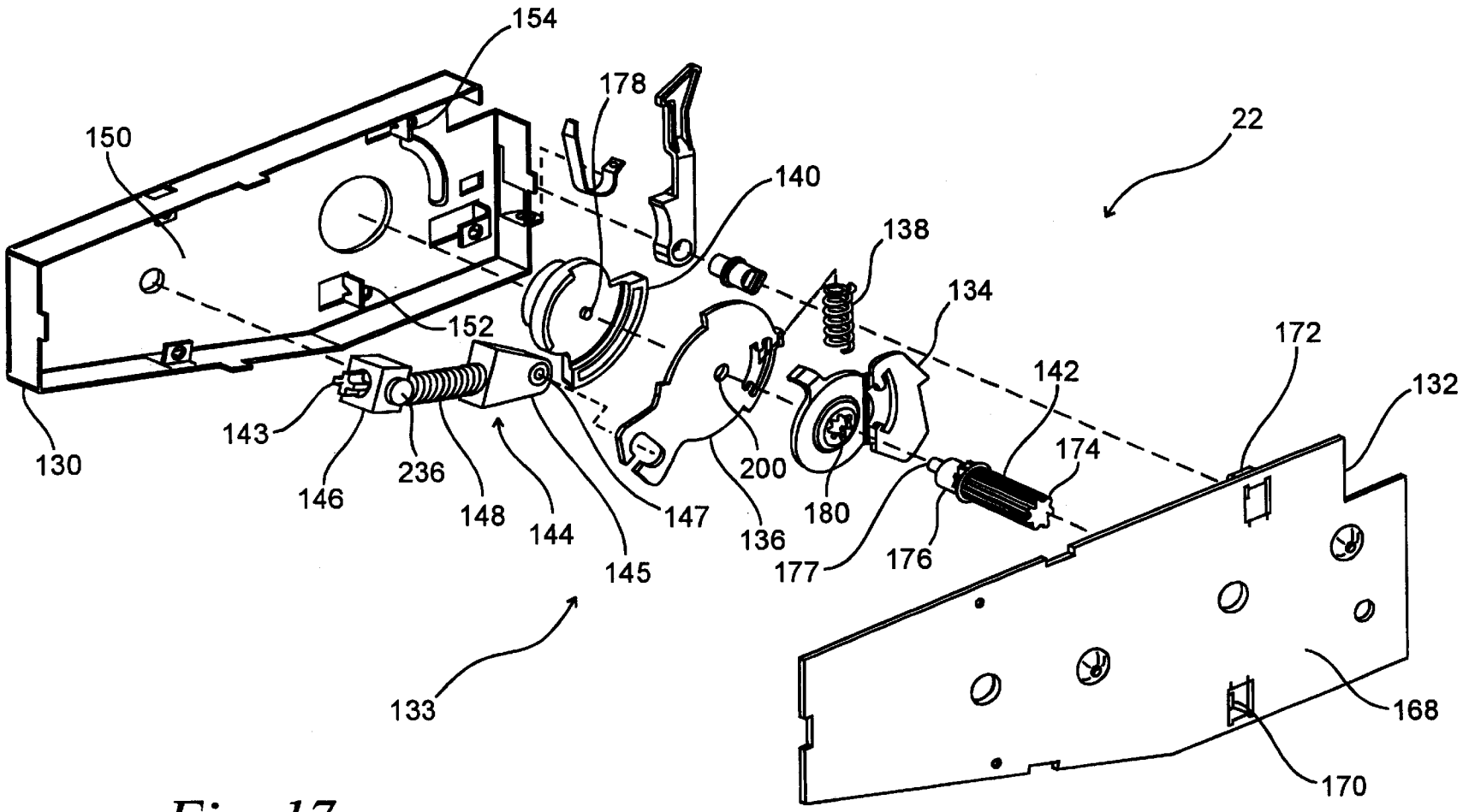
FIG. 17 is a exploded perspective view of the switch mechanism module of the present invention.

The modular interior switching assembly 20 is mated with a modular switch mechanism 22 to effect actuation of the switching assembly 20 upon movement of the handle 16. As shown in FIGS. 1 and 17, the switch mechanism 22 is connected at one end to the enclosure 12 and at the other end to the switching assembly 20, and includes a first housing member 130, a second housing member 132, and an internal operating mechanism 133, comprising: a handle cam 134, an operator cam 136, a bias spring 138, a rotor cam 140, a mechanism shaft 142, a push rod 144, a push rod pivot 146, and an operator spring 148.

Figure 19:
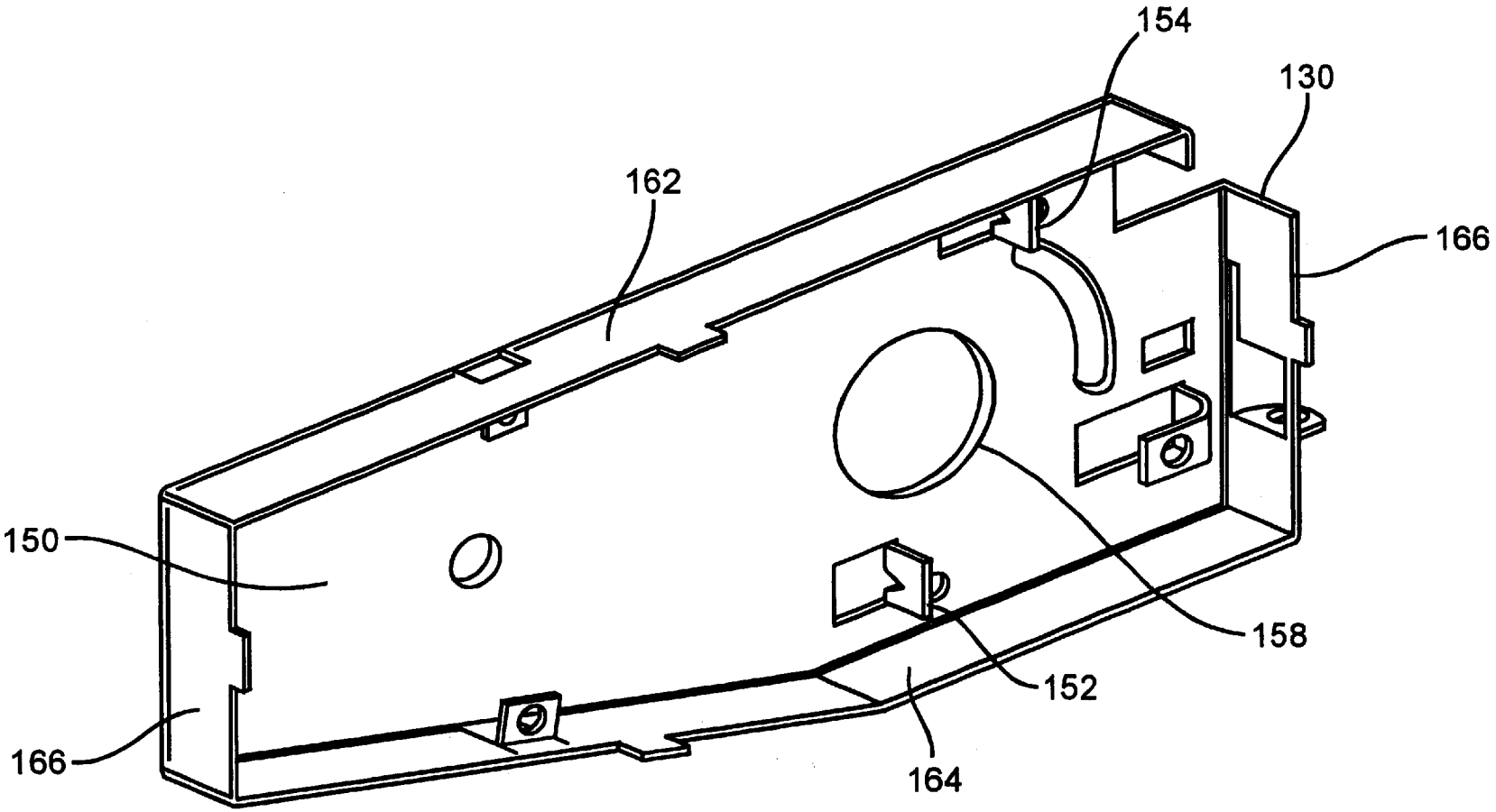
FIG. 19 is a perspective view of a housing member of the switch mechanism module of FIG. 17.

As shown in FIG. 19, the first housing member 130 has a substantially planar wall 150 and first and second integral stops 152,154 depending therefrom. The integral stops 152, 154 extend substantially perpendicular to the planar wall. In the preferred embodiment, the integral stops 152,154 depend from the substantially planar wall 150 of the first housing member 130. The first housing member 130 is manufactured from a 14 gauge galvanized steel sheet which is cut or punched to the appropriate dimension and then is formed accordingly by various bending procedures. In addition to the integral stops 152, 154 bent directly from the substantially planar wall of the first housing member, the first housing member 130 also has an aperture 158 therethrough in which the hub 160 of the rotor cam 140 extends. Further, the first housing member 130 has integral top 162, bottom 164, and sidewalls 166.

Figure 20:
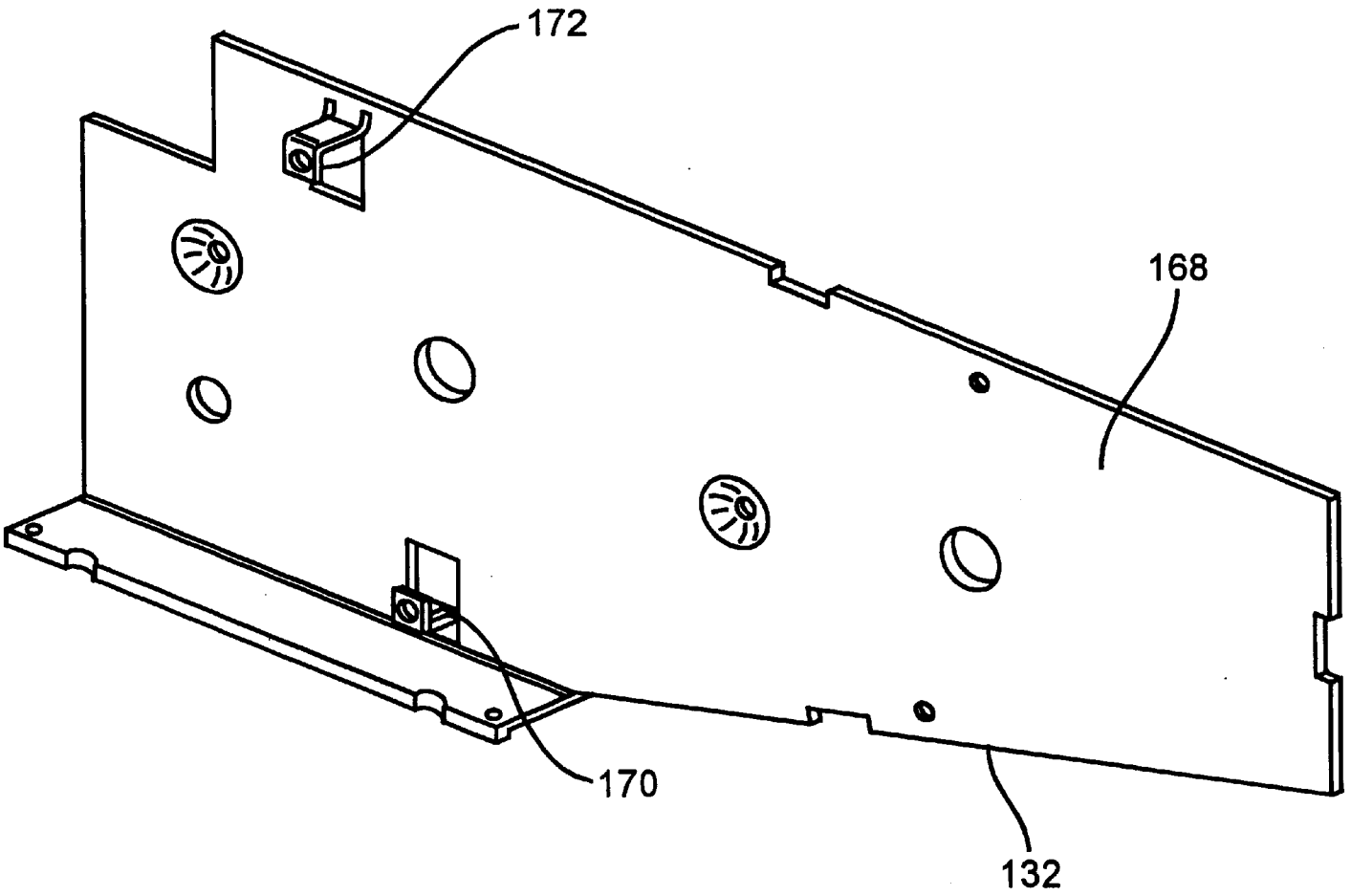
FIG. 20 is a perspective view of another housing member of the switch mechanism module of FIG. 17.

The second housing member 132 is shown in FIG. 20 and mates with the first housing member 130 to form an enclosure around the operating mechanism 133. In conjunction with fastening means, the first housing member 130 and the second housing member 132 are removably connected to each other. Like the first housing member 130, the second housing member 132 has a substantially planar wall 168, but instead of stops, integral first and second legs 170,172 depend from the second housing member 132. The distal end of the first and second legs 170,172 extend substantially parallel to the planar wall 168. In the preferred embodiment, the integral legs 170,172 depend from the substantially planar wall 168 of the second housing member 132. As such, when the first and second housing members 130,132 are joined together, the first leg 170 is directly adjacent and perpendicular to the first stop 152, and the second leg 172 is directly adjacent and perpendicular to the second stop 154. The first and second legs 170,172 are secured to the first housing member 130 to retain the legs 170,172 in position to assist the stops 152,154 in stopping a rotating cam. The second housing member 132 is manufactured from a 14 gauge galvanized steel sheet which is cut or punched to the appropriate dimension and then is formed accordingly by various bending procedures, one such bending procedure forming the integral legs 170,172.

Figure 18:
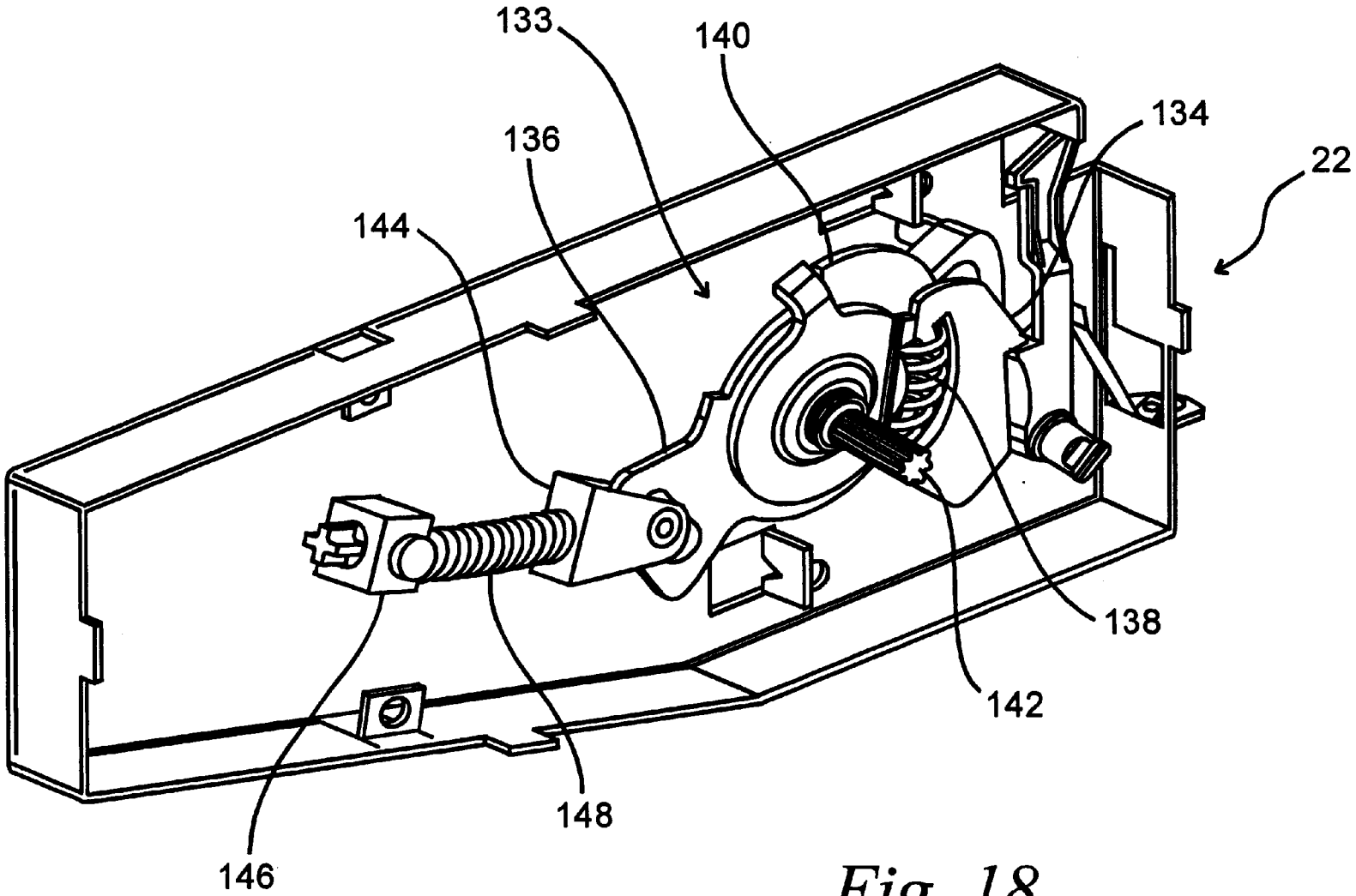
FIG. 18 is a perspective view of the switch mechanism module of the present invention.

The internal operating mechanism 133 of the present invention is shown in FIG. 18 and comprises a variety of components, including: a handle cam 134, an operator cam 136, a bias spring 138, a rotor cam 140, a mechanism shaft 142, a push rod 144, a push rod pivot 146, and an operator spring 148. The cams 134,136,140 of the operating mechanism 133 are adapted to rotate upon movement of the handle 16. When the switch mechanism 22 is fully assembled, the operating mechanism 133 is substantially within the mating first and second housing members 130,132.

As shown in FIG. 1, the handle 16 outside the enclosure 12 engages the switching mechanism 22 through the mechanism shaft 142. The mechanism shaft 142 is made of stainless steel and has a generally star-shaped first end 174 to engage the handle cam 134, an adjacent concentric shoulder 176 which mates with the aperture in the operator cam, and an indentation 177 at the second end thereof to mate with the nub 178 on the rotor cam 140.

Figure 23A:
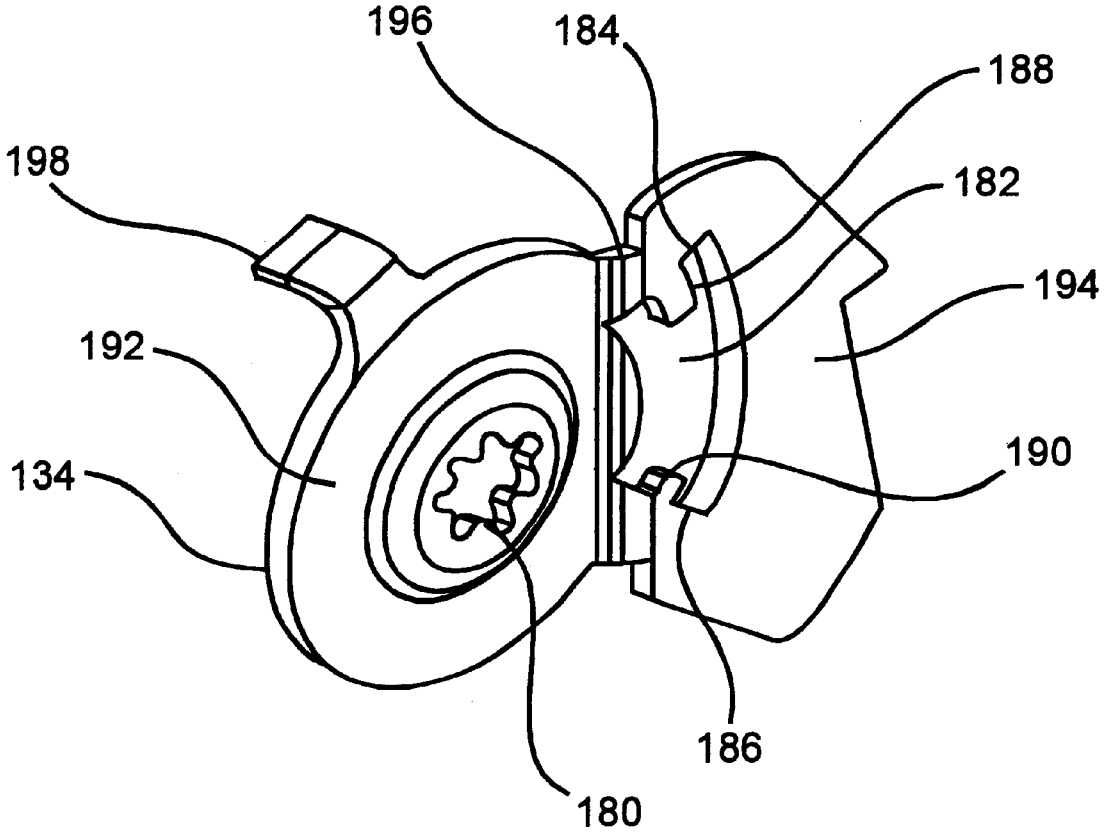
FIG. 23A is a front perspective view of another member of the switch mechanism module of FIG. 17.
Figure 23B:
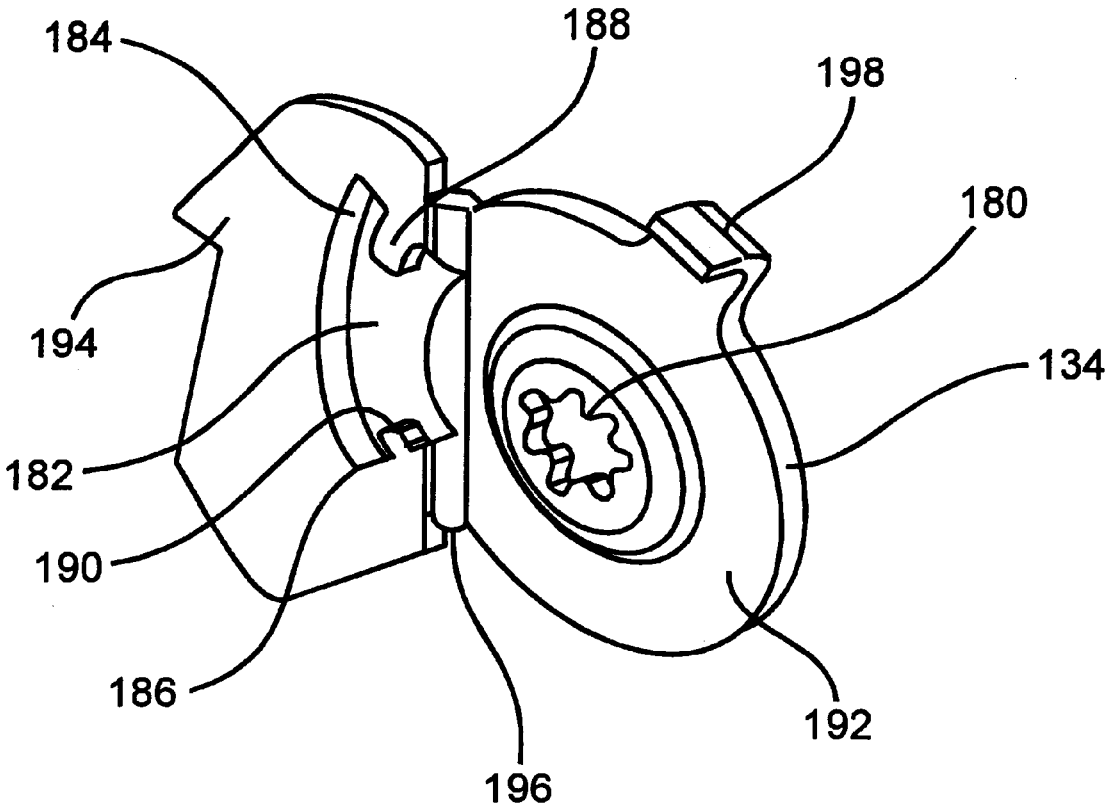
FIG. 23B is a rear perspective view of the member of FIG. 23A.

The handle cam 134 is illustrated in FIG. 23A and 23B. The handle cam 134 has an aperture 180 therethrough in the shape of a star to mate with the mechanism shaft 142. The star-shaped portion of the mechanism shaft 142 also mates with the handle 16 outside the enclosure 12. Accordingly, upon rotation of the handle 16, the handle cam 134 begins to rotate. The handle cam 134 also has a first arcuate slot 182 having a first end 184 and second end 186, with opposing first and second fingers 188,190 extending inward at the ends 184,186 of the slot 182. The handle cam 134 has first and second planar members 192,194, connected by an arcuate member 196. The aperture 180 of the handle cam is located in the first planar member 192, and the first arcuate slot 182 and fingers 188,190 thereof are located in the second planar member 194. An arcuate-shaped arm 198 extends radially from the first planar member 192 of the handle cam 134. The handle cam 134 is manufactured of an 11 gauge C.R.S. rawstock, which is cut and bent up to the final form shown in FIGS. 23A and 23B. The rawstock is then zinc chromate plated, case hardened, and normalized.

Figure 22A:
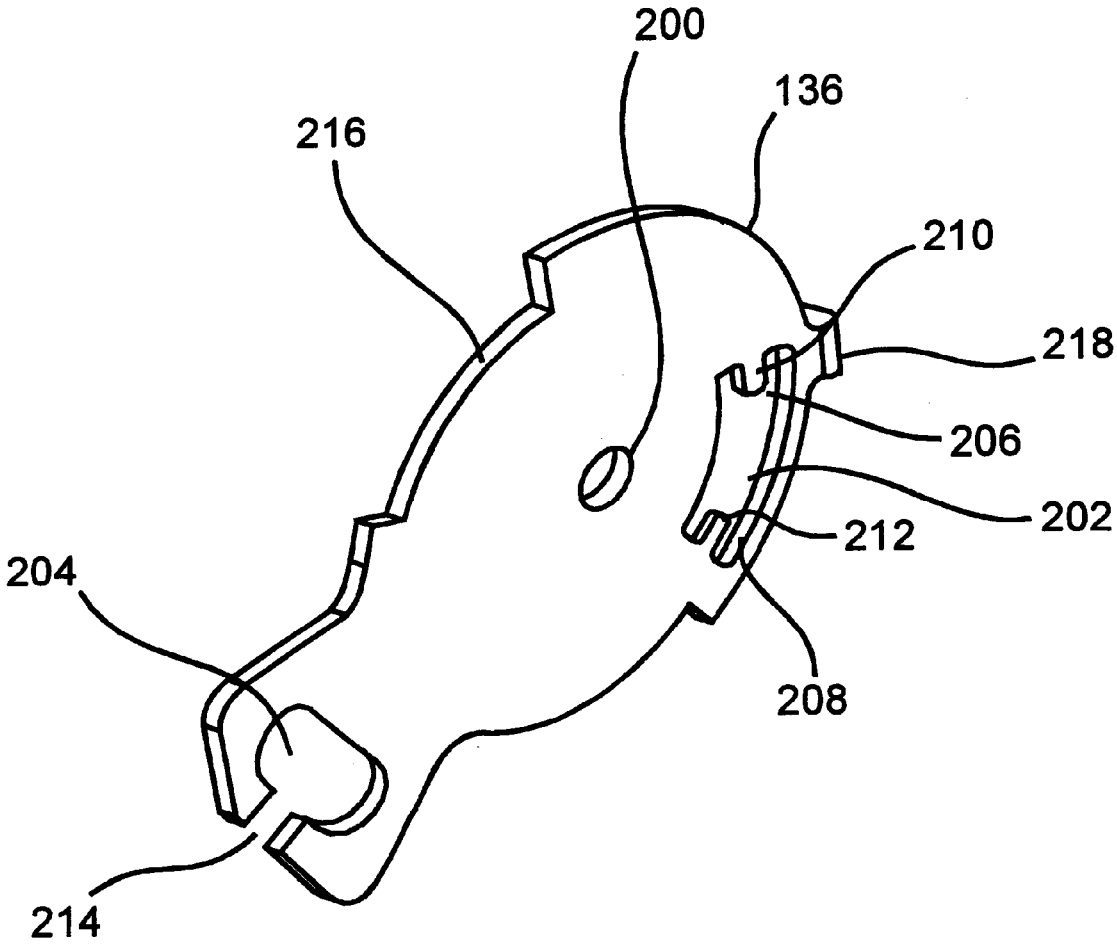
FIG. 22A is a front perspective view of another member of the switch mechanism module of FIG. 17.
Figure 22B:
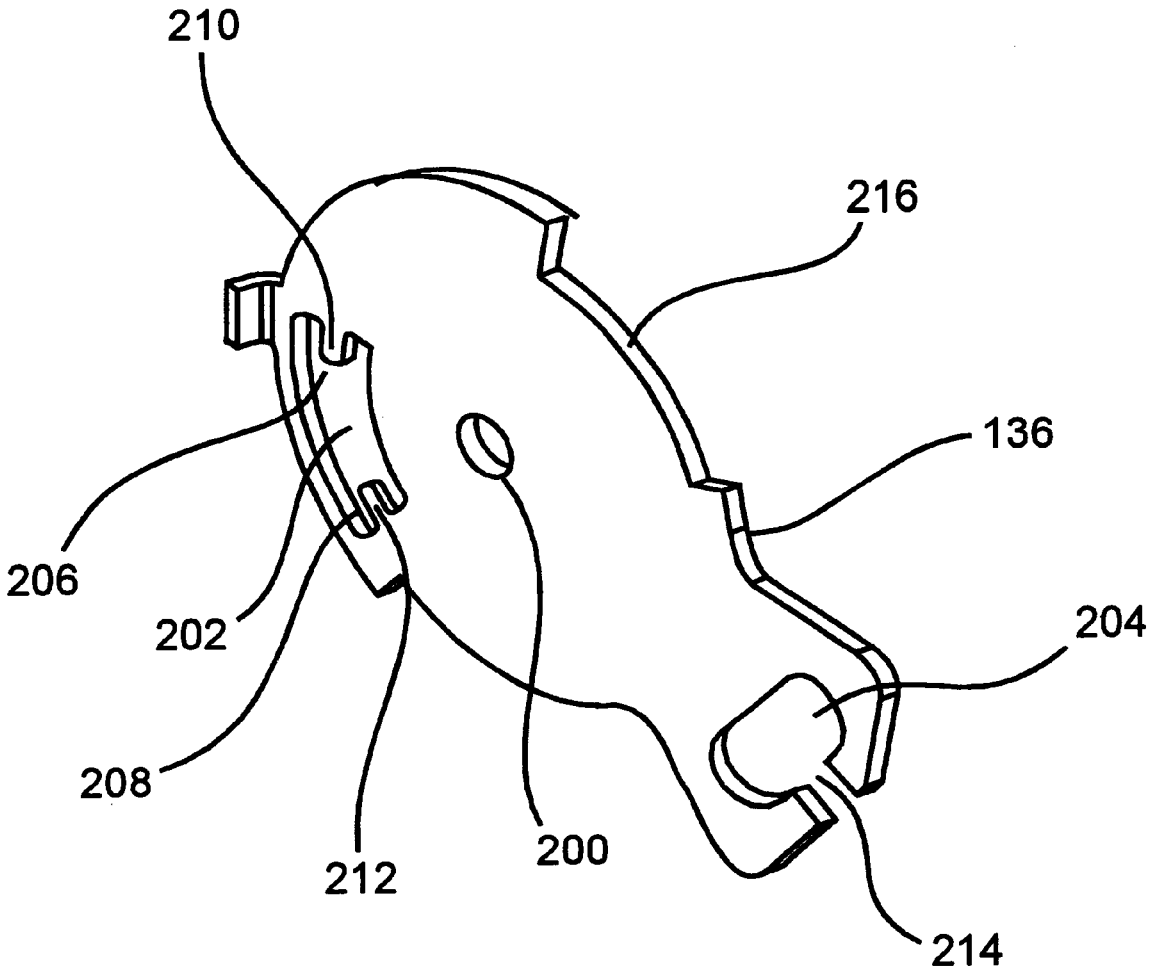
FIG. 22B is a rear perspective view of the member of FIG. 22A.

The operator cam 136 is illustrated in FIG. 22A and 22B. Like the handle cam 134, the operator cam 136 has an aperture 200 therethrough, but the aperture 200 of the operator cam 136 is substantially round, corresponding with the concentric shoulder 176 of the mechanism shaft 142 to allow the operator cam 136 to rotate about the mechanism shaft 142. The operator cam 136 also has a second arcuate slot 202 and a third arcuate slot 204. The second arcuate slot 202 has a first end 206 and second end 208, with opposing first and second fingers 210,212 extending inward at the ends 206,208 of the second slot 202. The third arcuate slot 204 has an opening 214 thereto. As shown in the figures, the operator cam 136 also has a notch 216 extending radially outward, and an arcuate-shaped and 218 extending radially therefrom. Unlike the handle cam 134, the operator cam 136 is substantially in one plane member, except for the arcuate-shaped and 218 thereof. The operator cam 136 is manufactured of an 11 gauge C.R.S. rawstock, which is cut and bent up to the final form shown in FIGS. 22A and 22B. The rawstock is then zinc chromate plated, case hardened, and normalized.

Figure 24:
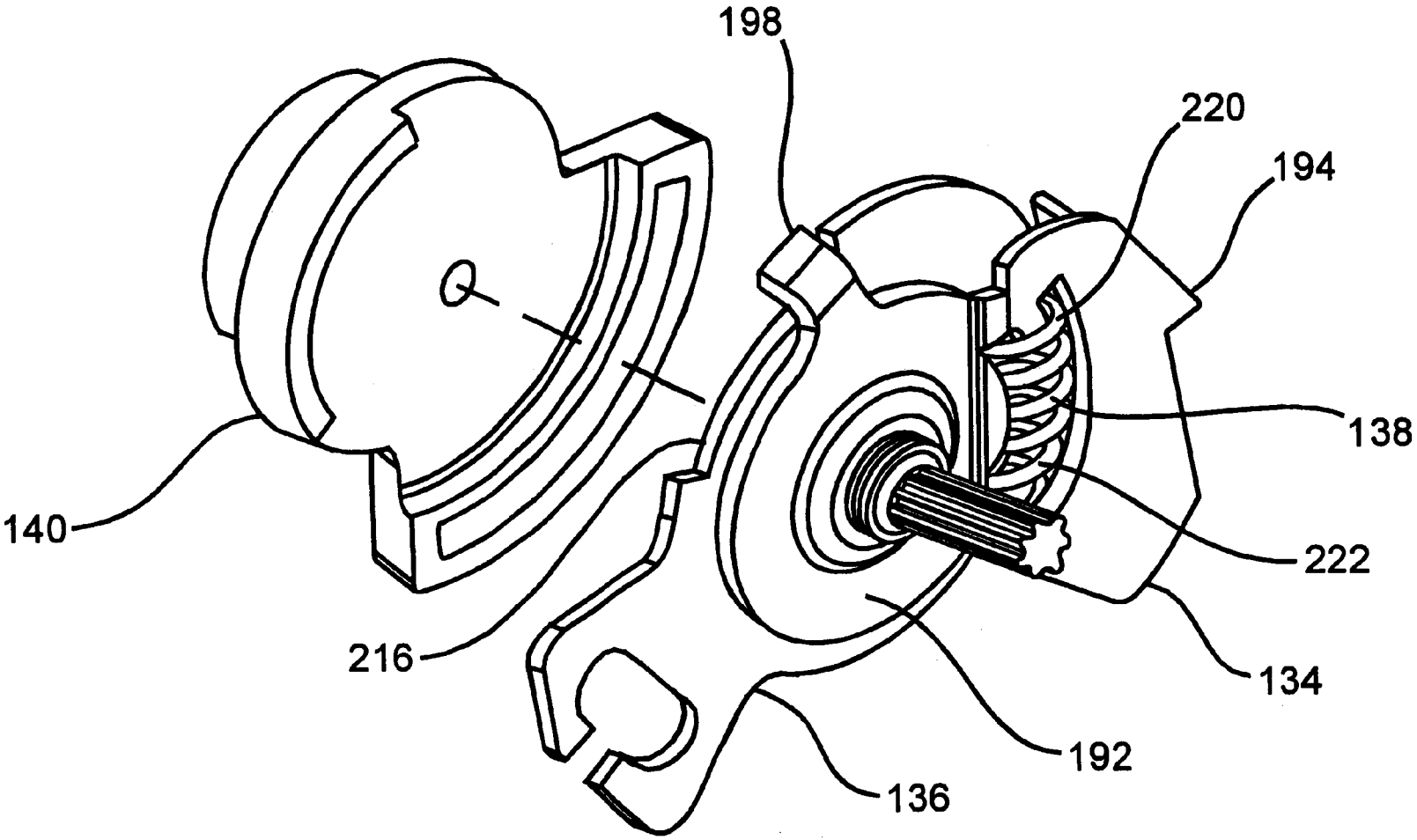
FIG. 24 is an exploded view of a portion of the switch mechanism module of FIG. 17; and, FIG. 25 is a perspective view of the portion of the switch mechanism module of FIG. 24.
Figure 25:
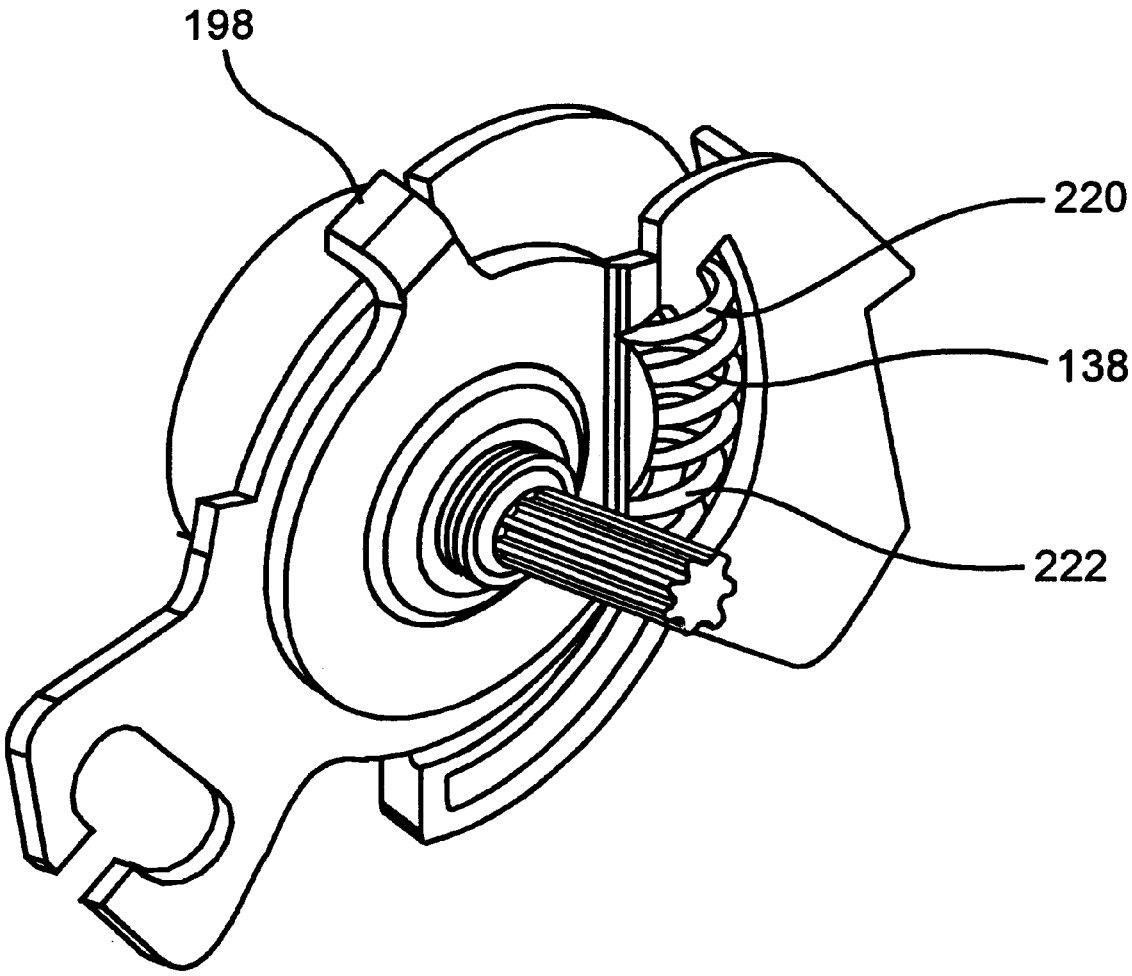

As shown in FIGS. 24 and 25, the bias spring 138 connects the handle cam 134 and the operator cam 136. The bias spring 138 is generally a compression spring, having a first end 220 and a second end 222. To connect the handle cam 134 with the operator cam 136, the first end 220 of the bias spring concurrently engages the first fingers 188,210 of the handle cam 134 and operator cam 136, and the second end 222 of the bias spring concurrently engages the second fingers 190,212 of the handle cam 134 and operator cam 136. When connected, the first planar member 192 of the handle cam 134 is adjacent the operator cam 136, and the second planar member 194 of the handle cam 134 extends a distance from the operator cam 136. Further, when connected the arcuate-shaped arm 198 of the handle cam 134 cooperates with the notch 216 of the operator cam 136.

Figure 21A:
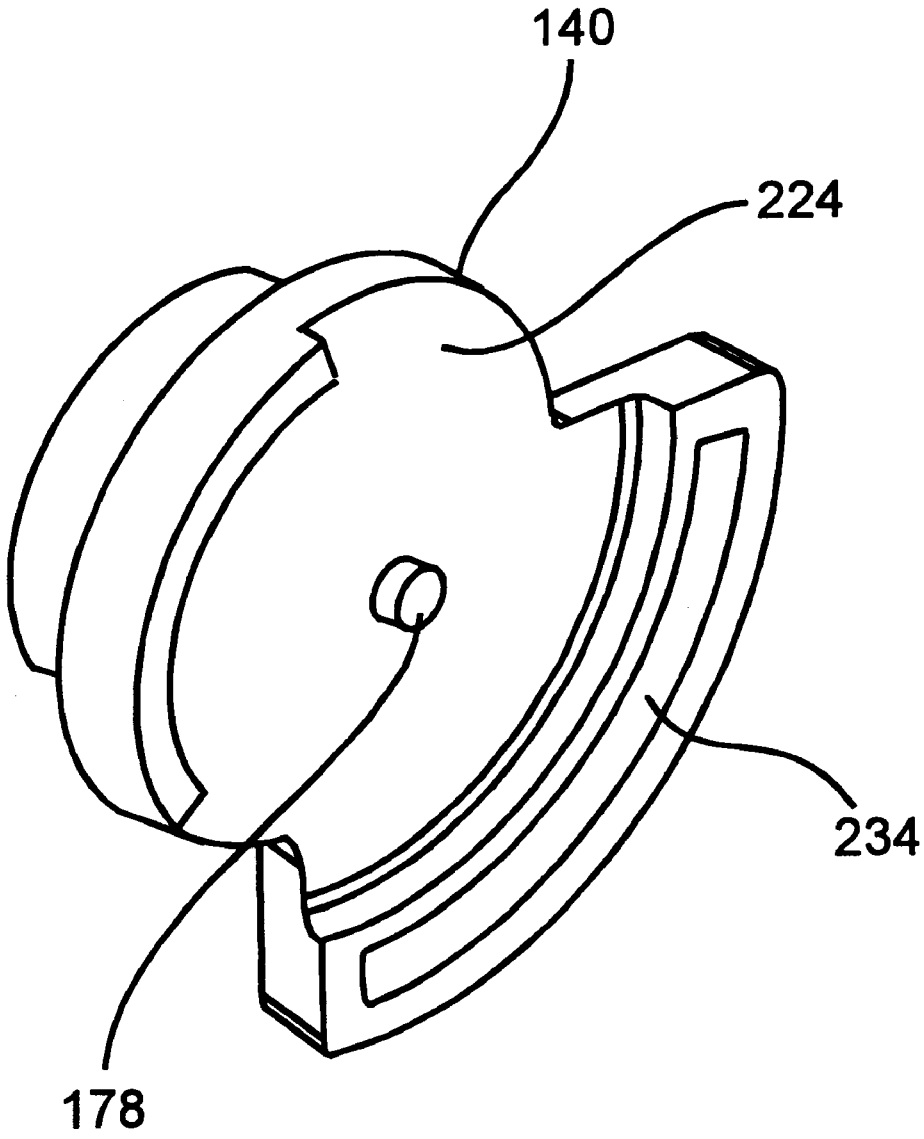
FIG. 21A is a front perspective view of one member of the switch mechanism module of FIG. 17.
Figure 21B:
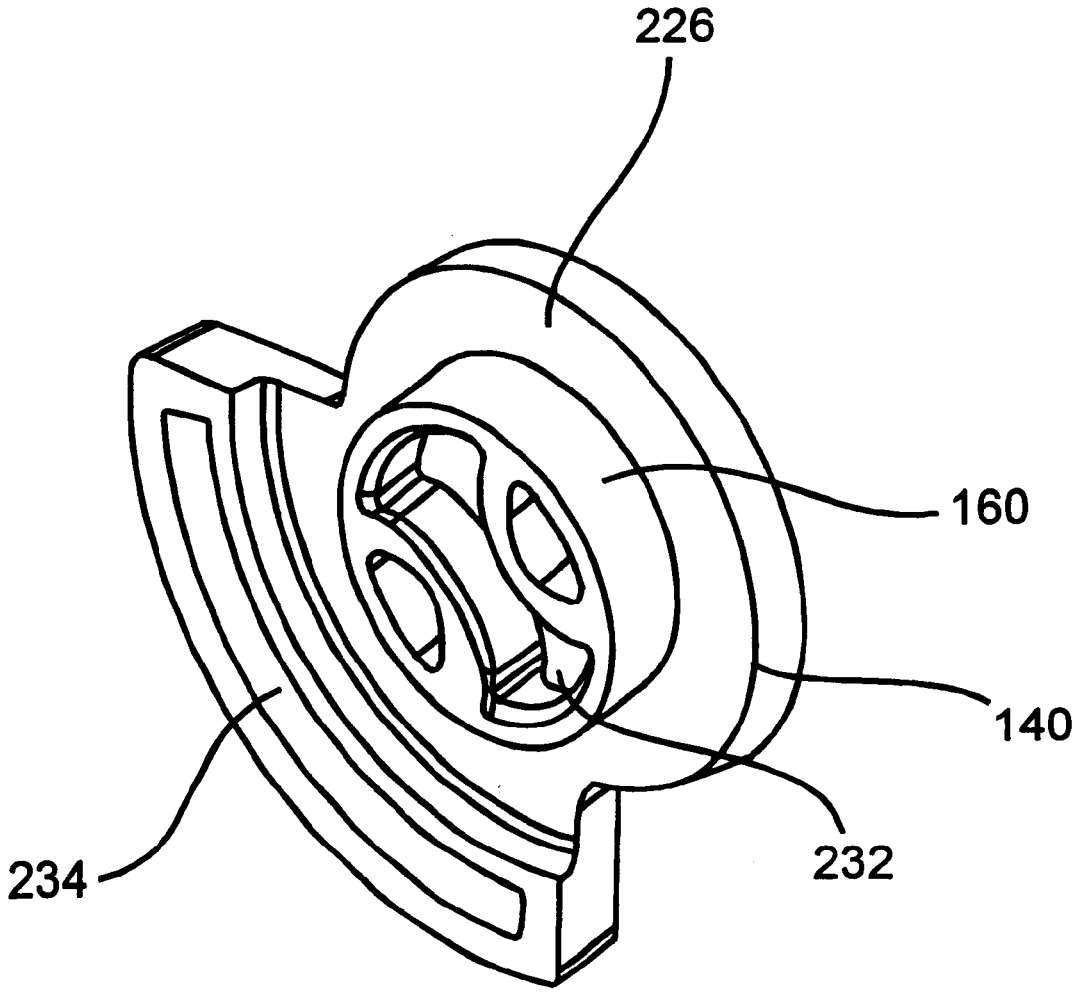
FIG. 21B is a rear perspective view of the member of FIG. 21A.

The rotor cam 140 is illustrated in FIGS. 21A and 21B. The rotor cam 140 has a first side 224 and a second side 226. A nub 178 extends from the first side 224 of the rotor cam 140, and a hub 160 extends from the second side 226 of the rotor cam 140. The nub 178 mates with the indentation 177 at the second end of the mechanism shaft 142, and is adapted to rotate thereabout. As shown in FIG. 21B, the hub 160 has a geometrically shaped indentation 232 adapted to mate with the protrusion 99 of the rotor element 33 to rotate the corresponding rotor elements 33 and blades 30. Additionally, the hub 160 extends from the first housing member 130, and the outer surface of the hub 160 mates with the aperture 158 of the first housing member 130. The rotor cam 140 also has an arcuate slot 234. When the rotor cam 140 mates with the mechanism shaft 142 having the handle cam 134 and operator cam 136 thereon, the arcuate-shaped arm 218 of the operator cam 136 cooperates with the arcuate slot 234 of the rotor cam 140 to rotate the rotor cam 140.

The operating mechanism 133 of the present invention also includes a push rod assembly 144 having a push rod 143, a push rod pivot 146, an operator spring 148, and a head 145, as illustrated in FIGS. 17 and 18. The push rod pivot 146 is connected to the first and second housing members 130,132 about a rotating shaft 236. The operator spring 148 is located around the shaft 143, and extends between the head 145 and the push rod pivot 146. The push rod 143 slidably extends into the push rod pivot 146, and pivotally slides thereabout. The head 145 of the push rod 143 has a transverse member 147 which fits into the third arcuate slot 204 of the operator cam 136. Rotation of the operator cam 136 causes the push rod 143 to extend into the push rod pivot 146, thereby compressing and energizing the operator spring 148.

To turn the switch "on" or "off" (i.e., to engage or disengage the blade 30 from the first contact member 36), the handle 16 is rotated. Rotation of the handle 16 causes rotation of the mechanism shaft 142, which in turn rotates the handle cam 134. The handle cam 134 is connected to the operator cam 136 by the bias spring 138. Accordingly, a force is produced in the bias spring 138 causing the operator cam 136 to rotate about the mechanism shaft 142. Additionally, the arcuate-shaped arm 198 of the handle cam 134 may engage one of the sides of the notch 216, respectively, to further rotate the operator cam 136. When the operator cam 136 begins to rotate, the push rod 143 moves within the third slot 204, causing the push rod 143 to pivot and be forced in the push rod pivot 146, thereby compressing and energizing the operator spring 148 and thus the push rod 143. Energizing of the operator spring 148 continues until the head 145 of the push rod 143 crosses a point of the third slot 204, typically the center line of the third slot 204. At that point, the operator spring 148 quickly accelerates the head 145 of the push rod 143, causing the head 145 to rapidly traverse to the opposite end of the third slot 204 of the operator cam 136, and causing the operator cam 136 to rapidly rotate simultaneously. As the operator cam 136 rotates, its arcuate-shaped arm 218 engages the arcuate slot 234 in the of the rotor cam 140, causing the rotor cam 140 to rotate about the mechanism shaft 142 and the aperture 158 in the first housing member 130. The hub 160 rotates together with the rotor cam 140, causing the rotor 33 engaged with the indentation 232 of the hub 160 to also rotate. As the rotor 33 rotates, the blades 30 simultaneously engage or disengage from the first contact member 36.

Because of the intense force produced by the operator spring 148 to rotate the operator cam 136, a cam stop must be employed to stop rotation of the components of the operating mechanism 133. The cam stops are the integral first and second stops 152, 154 of the first housing member. The first integral stop 152 of the first housing member 130 stops movement of the operator cam 136 in one direction, and the second integral stop 154 of the first housing member 130 stops movement of the operator cam 136 in the other direction. Specifically, the member 246 adjacent the first end of the third arcuate slot 204 contacts and is stopped by the first integral stop 152 when the operator cam 136 rotates in a first direction, and the member 248 adjacent the second end of the third arcuate slot 204 contacts and is stopped by the second integral stop 154 when the operator cam rotates in the opposite direction. The first integral leg 170 of the second housing member 132 provides reinforcement for the first stop 152 to prevent movement of the stop 152 in the direction of the rotating cam 136 when the cam hits the stop 152. The second integral leg 172 of the second housing member 132 provides reinforcement for the second stop 154 to prevent movement of the stop 154 in the direction of the cam when the cam hits the stop 154. The integral legs 170,172 also prevent the stops 152,154 from breaking off due to the extreme force exerted on the stops 152,154 when the operator cam 136 collides with the respective stop 152,154.

While the specific embodiments have been illustrated and described, numerous modifications come to mind without significantly departing from the spirit of the invention, and the scope of protection is only limited by the scope of the accompanying claims.

We claim:

1. A switch mechanism module for an electrical distribution device, the electrical distribution device having a switch assembly within an enclosure, and a handle external to the enclosure for controlling the switch mechanism module, the switch mechanism module comprising:

a first housing member having a substantially planar wall and an integral stop depending therefrom;

a corresponding second housing member mating with the first housing member, the second housing member having a substantially planar wall and an integral leg depending therefrom; and, an operating mechanism having a cam operably connected to the handle for rotation upon movement of the handle, wherein the first housing member and second member housing mate around the operating mechanism, wherein the integral stop of the first housing member stops movement of the cam in one direction, and wherein the integral leg of the second housing member provides reinforcement for the integral stop to prevent movement of the integral stop in the direction of the cam.

2. The switch mechanism module of claim 1, wherein the second housing member is removably connected to the first housing member by fastening means.

3. The switch mechanism module of claim 1, wherein the first housing member has a second integral stop depending therefrom, and wherein the second housing member has a second integral leg depending therefrom.

4. The switch mechanism module of claim 1, wherein the second integral stop depends from the substantially planar wall of the first housing member, and wherein the second integral leg depends from the substantially planar wall of the second housing member.

5. The switch mechanism module of claim 3, wherein the integral stop prevents further movement of the cam in one direction, and wherein the second integral stop prevents further movement of the cam in the opposite direction.

6. The switch mechanism module of claim 5, wherein the integral leg of the second housing member being adjacent and perpendicular to the integral stop provides reinforcement for the integral stop to prevent movement of the integral stop in a first direction of the cam, and wherein the second integral leg of the second housing member being adjacent and perpendicular to the second integral stop provides reinforcement for the second integral stop to prevent movement of the second integral stop in a second direction of the cam.

7. The switch mechanism module of claim 1, wherein the first and second housing members are manufactured from a piece of sheetmetal, respectively.

8. The switch mechanism module of claim 1, wherein the operating mechanism comprises:

a handle cam, an operator cam, a rotor cam, a bias spring connecting the handle cam and the operator cam, a mechanism shaft extending through an aperture in the handle cam and operator cam, a push rod pivot connected to the first housing member, the push rod pivot engaging a push rod, and an operator spring around the push rod, wherein the push rod further engages the operator cam.

9. The switch mechanism module of claim 8, wherein the handle cam has an arcuate slot with opposing fingers extending from the ends of the arcuate slot, wherein the operator cam has an arcuate slot with opposing fingers extending from the ends of the arcuate slot, and wherein one end of the bias spring engages the fingers at one end of the arcuate slots of the handle cam and the operator cam and the other end of the bias spring engages the fingers at the other end of the arcuate slots of the handle cam and the operator cam.

10. An operating mechanism for a switch mechanism module of a switch comprising:

a handle cam having an aperture, and a first arcuate slot with opposing fingers extending from the ends of the slot;

an operator cam having an aperture, a second arcuate slot with opposing fingers extending from the ends of the slot, and a third arcuate slot with an opening thereto;

a bias spring having a first end and a second end, the first end of the bias spring concurrently engaging the fingers at a first end of the first and second arcuate slots, the second end of the bias spring concurrently engaging the fingers at a second end of the first and second arcuate slots;

a rotor cam adjacent the operator cam, the rotor cam having a first side, a second side, and a nub thereon, wherein a hub extends from the second side of the rotor cam, the hub having a geometrically shaped indentation adapted to mate with a protrusion of a rotor of the switch; and, a shaft extending through the apertures in the handle cam and operator cam.

11. The operating mechanism of claim 10, wherein the operator cam has a notch extending radially outward, wherein the handle cam has an arcuate-shaped arm extending radially from the handle cam, and wherein the arcuate-shaped arm of the handle cam cooperates with the notch of the operator cam to stop rotation of the handle cam.

12. The operating mechanism of claim 10, wherein the handle cam has a plurality of planar surfaces, a first planar surface adjacent the operator cam and a second planar surface extending a distance from the operator cam, wherein the fingers of the arcuate slot of the handle cam are in the second planar surface.

13. The operating mechanism of claim 10, wherein the rotor cam has an arcuate slot, wherein the operator cam has an arcuate-shaped arm extending radially from the operator cam, and wherein the arcuate-shaped arm of the operator cam cooperates with the arcuate slot of the rotor cam to rotate the rotor cam.

14. The operating mechanism of claim 10, further comprising a first housing member having an aperture capable of mating with the hub of the rotor cam.

15. The operating mechanism of claim 10, further comprising a first housing member having a first integral stop depending therefrom, and a second integral stop depending therefrom, wherein the first integral stop of the first housing member stops movement of the operator cam in a first direction, and wherein the second integral stop of the first housing member stops movement of the operator cam in a second direction.

16. The operating mechanism of claim 11, further comprising a first leg and a second leg integral with the second housing member, the first leg being adjacent and perpendicular to the integral stop provides reinforcement for the first stop to prevent movement of the first stop in the direction of the cam, and the second leg being adjacent and perpendicular to the second integral stop provides reinforcement for the second stop to prevent movement of the second stop in the direction of the cam.

17. A switch mechanism module for an electrical distribution device, the electrical distribution device having a switch assembly within an enclosure, and a handle external to the enclosure for controlling the switch mechanism module, the switch mechanism module comprising:

a first housing member having a substantially planar wall and first and second integral stops depending therefrom;

a corresponding second housing member mating with the first housing member, the second housing member having a substantially planar wall and first and second integral legs depending therefrom; and, an operating mechanism substantially within the mating first and second housing members and having a handle cam connected to a operator cam with a bias spring, wherein the handle cam and the operator cam rotate about a shaft upon rotation of the handle, wherein rotation of the operator cam energizes a push rod engaging the operator cam such that an energized push rod accelerates the operator cam causing rotation of a rotor cam that rotates a rotor of the switch assembly, movement of the operator cam ceasing upon engagement of the operator cam with one of the first or second integral stops of the first housing member.

18. The switch mechanism of claim 17, wherein the integral first stop ceases movement of the operator cam in one direction, and wherein the integral second stop ceases movement of the operator cam in another direction.

19. The switch mechanism of claim 18, wherein the integral first leg of the second housing member being adjacent and perpendicular to the first integral stop provides reinforcement for the first integral stop to prevent movement of the first integral stop in the direction of the cam as the cam contacts the first integral stop, and wherein the integral second leg of the second housing member being adjacent and perpendicular to the second integral stop provides reinforcement for the second integral stop to prevent movement of the second integral stop in the direction of the cam as the cam contacts the second integral stop.

* * * * *